US007487589B2

(12) United States Patent
Smith et al.

(10) Patent No.: US 7,487,589 B2
(45) Date of Patent: Feb. 10, 2009

(54) AUTOMOTIVE HEAT EXCHANGER ASSEMBLIES HAVING INTERNAL FINS AND METHODS OF MAKING THE SAME

(75) Inventors: Paul R. Smith, Sinclairville, NY (US); Kellie M. Irish, Stockton, NY (US); Sam J. Lamancuso, Jamestown, NY (US); Kevin L. Freestone, Warren, PA (US); David S. Johnson, Kennedy, NY (US); Terrence P. Lynch, Frewsburg, NY (US)

(73) Assignee: Valeo, Inc., Auburn Hills, MI (US)

( * ) Notice: Subject to any disclaimer, the term of this patent is extended or adjusted under 35 U.S.C. 154(b) by 0 days.

(21) Appl. No.: 11/190,484

(22) Filed: Jul. 27, 2005

(65) Prior Publication Data

US 2006/0283585 A1 Dec. 21, 2006

Related U.S. Application Data

(60) Provisional application No. 60/591,680, filed on Jul. 28, 2004.

(51) Int. Cl.
*F28F 9/013* (2006.01)
*F28F 9/04* (2006.01)

(52) U.S. Cl. ..... 29/890.043; 228/183; 165/906; 165/173; 165/183

(58) Field of Classification Search ..... 29/890.049
See application file for complete search history.

(56) References Cited

U.S. PATENT DOCUMENTS

| | | | | | |
|---|---|---|---|---|---|
| 2,488,615 | A | * | 11/1949 | Arnold | 138/38 |
| 2,757,628 | A | * | 8/1956 | Johnston | 29/890.047 |
| 2,899,177 | A | * | 8/1959 | Harris et al. | 165/153 |
| 4,501,321 | A | | 2/1985 | Real et al. | |
| 4,805,693 | A | | 2/1989 | Flessate | |
| 4,813,112 | A | | 3/1989 | Pilliez | |
| 5,105,540 | A | | 4/1992 | Rhodes | |
| 5,372,188 | A | * | 12/1994 | Dudley et al. | 165/110 |
| 5,511,613 | A | * | 4/1996 | Mohn et al. | 165/177 |
| 5,555,729 | A | | 9/1996 | Momose et al. | |
| 5,560,424 | A | * | 10/1996 | Ogawa | 165/183 |
| 6,192,977 | B1 | * | 2/2001 | Dey et al. | 165/177 |
| 6,213,158 | B1 | * | 4/2001 | Rhodes et al. | 138/177 |
| 6,571,473 | B1 | * | 6/2003 | Nozaki et al. | 29/890.049 |
| 2005/0247444 | A1 | * | 11/2005 | Ohata et al. | 165/177 |

FOREIGN PATENT DOCUMENTS

| | | | |
|---|---|---|---|
| EP | 1 243884 | A | 9/2002 |
| FR | 2 777 645 | A | 10/1999 |
| GB | 1 533 466 | A | 11/1978 |
| GB | 2394037 | A * | 4/2004 |
| JP | 61 110892 | | 5/1986 |
| WO | WO 03/093751 | A2 | 11/2003 |
| WO | WO 2004/005831 | | 1/2004 |

* cited by examiner

*Primary Examiner*—Allen J Flanigan
(74) *Attorney, Agent, or Firm*—Dierker & Associates, P.C.

(57) ABSTRACT

The present invention relates to automotive heat exchanger assemblies that can withstand high environmental temperature and pressures conditions. By providing a tube strengthener inserted into the tubes at the areas of highest stress, the heat exchanger assembly is strengthened to be efficient under typical operating conditions.

12 Claims, 14 Drawing Sheets

AUTOMOTIVE HEAT EXCHANGER ASSEMBLIES HAVING INTERNAL FINS AND METHODS OF MAKING THE SAME

This patent application claims priority of Provisional application 60/591,680 filed Jul. 28, 2004.

FIELD OF THE INVENTION

The present invention relates to automotive heat exchangers, and, in particular, brazed heat exchangers.

BACKGROUND OF THE INVENTION

Various types of heat exchangers are used in automotive applications. For example, WO03093751, published on Nov. 13, 2003, assigned to Behr, relates to a radiator with an internal fin section, and a short section of tube inside the primary tube. In various evaporator applications, as for example illustrated in WO 2004/005831, evaporators are shown to be provided with a fin that fits against the tube radius for the full length of the tube.

U.S. Pat. No. 5,105,540 issued on Apr. 21, 1992, to Ford Motor Company shows a tube with an internal liner stock for increasing the interior fluid turbulation. U.S. Pat. No. 4,501,321 issued on Feb. 26, 1985, to Blackstone Corporation shows a two piece tube with the overlap occurring at the minor dimension. U.S. Pat. No. 4,813,112, issued on Mar. 21, 1989, to Societe Anonyme des Usines Chausson shows a reinforcement plate on the ambient side of the header to locally reinforce the tube to header joint. U.S. Pat. No. 4,805,693 issued on Feb. 21, 1989, to Modine Manufacturing shows a two piece tube with the overlap occurring at the diameter of the tubing. The above references are incorporated by reference herein.

In recent years, the temperatures and pressures of so-called 'turbo-charged' air has significantly increased, resulting in failure of heat exchangers such as those of prior art charge air coolers (CACs), and after coolers due to thermal stresses. In such temperature/pressure conditions, a major disadvantage of prior art designs has been common failures, such as fatigue fracture, of both the tube and the internal fin.

In prior art designs, specific fractures, such as transverse fractures, may occur, for example, at tube locations, and, in particular, at the inlet header of the heat exchangers. Also, internal fin fracture may occur and lead to contamination in heat exchangers such as the charge air in coolers.

Higher temperatures and pressures for CACs are being specified by customers. Even with material changes, increased thickness of materials will be needed to meet these new requirements. Increasing material thickness, which further drives costs. The primary manner in which this has been addressed is through increasing the robustness of the tube through increasing thickness of tube and internal fin. Also, through the adoption of high strength alloys. Although effective in improving durability, these changes require significant tooling, process change, material cost, and overall costs of producing a durable charge air cooler.

There exists a need for a heat exchanger assembly with localized strength which is cost effective and improves durability with increasing pressure/temperature applications.

SUMMARY OF THE PRESENT INVENTION

The present invention provides for a heat exchanger assembly, especially comprising a heat exchanger such as an after cooler or charge air cooler for automotive applications, wherein a tube strengthener is provided to allow for a more thermally resistant or 'robust' after cooler or charged air cooler. Specifically, aspects of the present invention provide for an increase in resistance to thermal and pressure stresses in heat exchangers or heat exchanger assemblies, and, especially, in and near the specific areas in which thermal fatigue failures typically occur, (e.g. the area of the tube and internal fin at or next to the header in a heat exchanger assembly). It can be used at any location determined to need additional strength.

The present invention, in various embodiments, therefore, provides for a heat exchanger assembly with an improved thermal/pressure resistant heat exchanger (e.g. a heat exchanger with an increased thermal durability yielding increased functional life of the heat exchanger assembly), in high pressure and or temperature environments found in after coolers, and, especially, in charge air coolers.

Provision of a strengthened tube wall for after cooler and CAC heat exchanger assemblies wherein there are greatly reduced or even insignificant and/or largely inconsequential effects on heat transfer and internal restriction vis-à-vis prior art CAC heat exchanger assemblies without such tube strengtheners, occurs in embodiments of the present invention.

Preferred aspects of the present invention provide improved thermal durability without a major design change from presently used designs that affect the complete heat exchanger. These aspects of the present invention affect a localized portion of that heat exchanger, and, therefore, can be applied to current designs using minor modifications to current manufacturing processes. Cost reduction opportunities exist by allowing for use of thinner and less expensive alloys on both the tubes and internal fins, as well as providing for a more competitive method of achieving increasing design requirements with current technologies. In particular, the use of a tube strengthener allows design elements at specific location or locations in the cross section of a tube with one variation providing differing thickness in one or more of those structural elements.

By tube strengthener it is meant a complete modified inner fin or internal fin, or piece or part or section of a modified inner fin or internal fin, useful to provide strength at an area of stress or stress in a tube, while retaining some heat transfer properties. An inner fin or internal fin is typically placed inside a heat exchanger tube prior to brazing the heat exchanger assembly. The inner fin or internal fin (hereafter "internal fin") when brazed to the interior wall of the heat exchanger tube forms a structure resistant to the required operating temperatures/pressures of the heat exchanger, as well as additional heat transfer surfaces. A tube strengthener is designed to be applied to localized areas in the heat exchanger where temperature/pressure stress resistance greater than provided by the internal fin is required to meet durability requirements while retaining some heat transfer properties.

As shown in FIG. 2, a complete fin can be comprised of pieces or parts or sections, particularly end sections, said sections referred to herein as outermost or first and/or final internal fins. In embodiments of the present invention, a tube strengthener, and, in certain circumstances, a tube strengthener replacing the end internal fin, and more particularly, an outermost or first and/or final internal fin(s,) is provided. Prior art tubes and inner fins are typically thickened or employ high strength alloys to resist increasing temperature and pressure stresses. The aspects of the present invention, by applying a tube strengthener at selected locations of the final heat exchanger assembly, not only maintains, but substantially increases, the functional life span of the heat exchanger assembly, particularly in an after cooler, and, more particularly, in charge air cooler applications. In some embodiments of the present invention, the tube strengthener, therefore, can be brazed to the inner tube wall thereby contacted. In even more preferred embodiments, the tube strengthener increases the over all tube wall thickness or width at the area of contact, more preferable, i.e. the thickness of the strengthener plus tube wall thickness is equal to or greater than the normal tube wall thickness. In most preferred embodiments, the tube strengthener is positioned at the area of high, and, in particular, highest thermal stress in the heat exchanger assembly, for example between the tube and header, or other appropriate locations.

The present invention, in its various aspects, is likely to reduce the likelihood of internal fin fracture during heat exchanger operation, and to decrease the overall rate of potential fracture and propagation of such fractures through heat exchanger assemblies tubes, and, particularly, after cooler and CAC heat exchanger assembly tube walls.

In one aspect of the present invention, at least one tube strengthener, which hereafter is known as tube strengthener-end contact, is provided. By tube strengthener-end contact is meant a modified or formed fin, with a thickness equal to or greater than the internal fin which it substitutes, which preferably replaces or is located in the area where normally is located an outermost internal fin in the tubes of a heat exchanger, which fin or part of fin is especially formed to contact the internal surface of the minor tube dimension, being brazed to the minor tube dimension and retaining some heat transfer properties while improving temperature/pressure durability at a specific location in the heat exchanger. By design the features of the tube strengthener-end contact allow for contact with the inner surface or surfaces of a heat exchanger tube at an identified or determined location or locations of highest stress, normally the minor dimension, the stress areas affected by providing additional thickness of material directly at and adjacent to the location of greatest stress.

In aspects of the present invention using a tube strengthener-end contact comprising a modified formed internal fin, durability of the heat exchanger is increased by brazing the tube strengthener-end contact to the interior surface of a tube, especially in place of an existing internal fin and on the inside surface of the tube minor dimension which is typically the location of highest stress in a tube. These aspects of the present invention allow, therefore, a resistance to thermal fatigue in high stress areas. By providing for a structure and in particular an increase in tube wall thickness on the minor dimension existing material thicknesses and alloys may be used in all but the highest stress area of a CAC. Reduced material gages are possible in such heat exchangers, while having an improvement in cost of the heat exchanger assembly. By determining the area of need for strength in the tube of the heat exchanger, different tube strengthener-end contact thicknesses and fin pitches can be specified. In embodiments of the present invention, use of a tube strengthener-end contact increases wall thickness in the tube's end radius where fractures often occur. In accordance with these aspects of the present invention, the highest thermal/pressure stress concentration problems are typically at the radius of the tube adjacent to the tube to header braze joint which are solved by use of the tube strengthener.

As described hereinabove, various aspects of the present invention add strength to heat exchangers, such as CACs, at specific locations of highest stress, normally within the first sections of tube past the end of an inlet tube. In some of the preferred aspects, the strength is added by inserting a short section of tube strengthener-end contact, such as an internal fin or fin section of greater than 25% the thickness of the tube wall, and brazing a portion of that thickened internal fin across the location of highest stress to create a thickened tube strengthening structure that resists the thermal fatigue in the high stress area, which typically is the minor dimension of a tube. These aspects or embodiments enable heat exchanger formation requiring no more than the standard or existing material thicknesses and use of traditionally used alloys in all but the highest stress area of the heat exchanger, such as a CAC. Reduced material gages are possible in such heat exchangers, while having an improvement in cost characteristics of the heat exchanger assembly for lower temperature/pressure applications.

In one aspect of the present invention, at least one tube strengthener, which hereafter is known as tube strengthener-structural, is provided. By tube strengthener-structural is meant a modified or formed fin or fin section, with a thickness equal to or greater than the internal fin which it substitutes, which preferably replaces or is located in the area where normally is located an outermost internal fin in the tubes of a heat exchanger, which fin is especially formed to contact the locations of highest stress in the tube and also having a structure formed into the tube strengthener-structural adjacent to the location of highest stress, being brazed to the minor tube dimension and retaining some heat transfer properties while improving temperature/pressure durability at a specific location in the heat exchanger. By design the features of the tube strengthener-structural allow for contact with the inner surface or surfaces of a heat exchanger tube at an identified or determined location or locations of highest stress, normally at a portion of minor dimension, the stress areas are affected by providing additional thickness of material directly at the location of greatest stress with additional strengthening by having a structure adjacent to the location of highest stress to further resist thermal/pressure stresses.

In aspects of the present invention using a tube strengthener-structural comprising a modified formed internal fin, durability of the heat exchanger is increased by brazing the tube strengthener-structural to the interior surface of a tube, especially in place of an existing internal fin and at the location of highest stress which is normally on the inside surface of the tube minor dimension with a structural feature formed into the tube strengthener-structural adjacent to the location of highest stress in the tube. These aspects of the present invention allow, therefore, a resistance to thermal fatigue in high stress areas. By providing for an adjacent structure and in particular an increase in tube wall thickness at the location of highest stress, existing material thicknesses, and alloys may be used in all but the highest stress area of a CAC. Reduced material gages are possible in such heat exchangers, while having an improvement in cost of the heat exchanger assembly. By determining the area of need for strength in the tube of the heat exchanger, different tube strengthener-structural thicknesses, formed structures, and fin pitches can be specified. In embodiments of the present invention, use of a tube strengthener-structural increases wall thickness at the location of highest stress where fractures often occur and additionally forming a stiffening structure into the tube strengthener-structural adjacent to the location of highest stress as a further resistance to thermal fatigue. In accordance with these aspects of the present invention, the highest thermal/pressure stress concentration problems are typically at the radius of the tube adjacent to the tube to header braze joint which are solved by use of the tube strengthener-structural.

As described hereinabove, various aspects of the tube strengthener-structural add strength to heat exchangers, such as CACs, at specific locations of highest stress, normally within the first sections of tube past the end of an inlet tube. In some of the preferred aspects, the strength is added by inserting a short section of tube strengthener-structural, such as an internal fin section of greater than 25% the thickness of the tube wall, brazing a portion of that thickened internal fin across the location of highest stress to create a thickened tube strengthening structure with an additional formed structure that resists the thermal fatigue in the high stress area, which typically will be at the minor dimension of a tube. These aspects or embodiments enable heat exchanger formation requiring no more than the standard or existing material thicknesses and use of traditionally used alloys in all but the highest stress area of the heat exchanger, such as a CAC. Reduced material gages are possible in such heat exchangers, while having an improvement in cost characteristics of the heat exchanger assembly for lower temperature/pressure applications.

In one aspect of the present invention, at least one tube strengthener, which hereafter is known as tube strengthener-extruded, is provided. By tube strengthener-extruded is meant an extruded internal fin, the tube strengthener having a central web or multi-structural support feature or element, which substitutes, replaces, or is located in the area where, in preferred embodiments, normally is located an outermost internal fin in the tubes of a heat exchanger, and, in specific embodiments, of a CAC while retaining some heat transfer properties. The central web is designed to have projections in it at specific or selected locations. The preferred embodiments of the present invention have at least one, preferably, a plurality of extruded projections with a multi-structural support feature or element (central web) designed to fit into a tube of the heat exchanger in place of or in substitution of or placed where would normally be located, a traditional internal fin or section. By design, the features attached to the central web allow for contact with the inner surface or surfaces of a heat exchanger tube at an identified or determined location or locations of highest stress, the stress areas are affected in at least two different ways: by providing a direct structure to resist the thermal forces; and, to provide additional thickness of material directly at and only at the location of greatest stress.

In aspects of the present invention using a tube strengthener-extruded comprising extruded internal fin (extruded tube strengthener) durability is increased by inserting a 'structure' (for example, a section or sections of extruded internal fin), typically a structure or structures which are projections or extensions or branches or arms off a central web. In aspects of the present invention where heat exchangers are brazed, brazing those structures to the inside of a tube at the locations of highest stress. These aspects of the present invention allow, therefore, a resistance to thermal fatigue in high stress areas. By providing for a structure, and, in particular, a structure coming off of a central web arrangement, existing material thicknesses and alloys may be used in all but the highest stress area of a CAC. Use of such a structure, and, in particular, a structure coming off of a central web, in embodiments of the present invention, are also used to reduce material gages in CACs with a corresponding improvement in cost control and performance enhancement. The section thickness of, for example, of the projections, can vary to add material into areas of highest stress and minimize material in lower stress areas. The use of varying material thickness in the embodiments of the present invention utilizing an tube strengthener-extruded, also assists in minimalizing potential pressure drop affect due to tube blockage at its opening or other such blockage. Also in embodiments of the present invention, the structural projection, extension, branches or arms, or the like may be of various thicknesses. By determining the area of need for strength in the tube of the heat exchanger, different structural projections, extensions, branches or arms may be of different thicknesses at different locations off the central web. The use of an extruded tube strengthener, in embodiments of the present invention with a central web, adds strength at a the specific location or locations of highest thermal/pressure stress in a charge air cooler. Also, the amount of material used to provide the maximum strength is provided by providing increased thickness and structure, as needed, in the location or locations of highest thermal/pressure stress. These aspects or embodiments enable heat exchanger manufacture (formation) requiring no more than the standard or existing material thicknesses and use of traditionally used alloys in all but the highest stress area of the heat exchanger, such as a CAC. Reduced material gages are possible in such heat exchangers, while having an improvement in cost characteristics of the heat exchanger assembly for lower temperature/pressure applications.

Aspects of the present invention solve various problems, including the strength problem, by adding strength, for example, to a CAC, at a specific location or locations of highest stress, normally within the first 25 mm past the end of an inlet tube One aspect of a tube strengthener significantly reduces the potential of failures, and, particularly, thermal/pressure fatigue failures. In preferred embodiments of the present invention it has been found that thermal stress resistance upward of 200 percent (to about 400 percent or more) can result using some embodiments of the present invention, with the tube strengthener leading to significant durability of both the tube and the heat exchanger assembly.

The alternative or preferred embodiments of the present invention, therefore, provide a cost effective method for increasing the thermal/pressure resistance or thermal durability of CAC designs in high temperature applications (>220 C). Additional potential of reducing material costs in high temperature applications (>220 C) also exists.

Additional embodiments provide a concurrent reduction in tube thickness and, particularly, internal fin thickness, without deleteriously affecting the thermal/pressure durability of the heat exchanger assembly, particularly in after cooler or CAC applications, in lower temperature environments (<220 C).

The embodiments of the present invention further preferably provide for greatly improved thermal/pressure durability without the cost associated with design, tooling, or major process changes, seen in the prior art.

By distributing stress (reducing fatigue) associated with the bending moment, particularly amongst internal components of the CAC (e.g. tube and core versus the header and tank) stress is 'taken away' or substantially reduced in the 'high stress' area or area of stress concentration such as that found at the braze joint with header.

In embodiments of the present invention, the tube strengthener is positioned at high stress areas or areas of stress concentration to eliminate the potential of outer internal fin fracture near or at the inlet header, and subsequent or associated propagation of fracture through the tube wall.

In preferred methods of the present invention, minor modification of manufacturing operation, with no additional labor or other significant modifications, provides for a heat exchanger with tube strengthener with the qualities of increased lifetime for the heat exchanger assemblies, particularly in CAC applications.

In preferred methods of the present invention, manual or automated means may be used for tube stuffing (i.e. insertion of a internal fin into the tube).

In a particularly preferred method of the present invention, an automated tube stuffer is provided to insert an internal fin into the tube, wherein the tube location within the core and within the tube strengthener replaces the first and or final internal fin or fin portions inserted into the tube. Also in preferred embodiments of the present invention, a tube strengthener may be applied to ameliorate stresses in CAC designs, The internal fin is replaced by the tube strengthener at the areas of highest stresses.

The present invention also provides, in one aspect, a method for reducing 'contamination' of charged air, by, for example, internal fins which typically cleave chips on the inlet side of a CAC due to the high stresses at the inlet tube to header joint. By positioning the tube strengthener in an area of stress, in a tube wall, brazing the tube strengthener as part of the heat exchanger brazing process subsequently reduces contamination from the internal fin, in charge air coolers.

DETAILED DESCRIPTION OF THE PREFERRED EMBODIMENT

In aspects of the present invention, there is a heat exchanger assembly comprising: a first end tank; a second end tank opposite the first end tank; at least one first tube in fluid communication with the first and second end tanks, the at one least first tube adapted to have a first fluid flow therethrough, at least one tube strengthener; at least one internal fin; wherein the at least one tube strengthener and the at least one internal fin is positioned inside the at least one tube. In particular embodiments of the present invention, the heat exchanger assembly is brazed. In particular embodiments of the present invention, the at least one tube and the at least one end tank contact each other to form a header joint. Embodiments of the present invention have a tube strengthener that is a tube strengthener-end contact or tube strengthener-structural, or the tube strengthener is a tube strengthener-extruded.

In some preferred embodiments of the present invention, the modified fin is positioned inside the tube such that the outermost modified fin contacts and follows the contour of the inside wall of the tube on either the radius or minor dimension.

The modified fin and tube in embodiments of the present invention, have an overall thickness at the point of contact is approximately equal to or greater than to the thickness of the tube at areas outside of the area of contact between the fin and tube. In embodiments of the present invention, the fin and tube overall thickness at the point of the header joint is greater than or equal to the thickness of the tube at areas outside of the area of contact between the fin and tube. Another aspect of the present invention comprises a heat exchanger assembly comprising: a first end tank; a second end tank opposite the first end tank; at least one first tube between the first and second end tanks; at least one tube strengthener; wherein the at least one tube strengthener is positioned inside the at least one tube. In particular embodiments, the at least first tube is in fluid communication with the first or second end tank. In particular, the at least one first tube is adapted to have a fluid flow therethrough. A heat exchanger assembly, in aspects of the present invention, for example, may comprise a heat exchanger that is a turbo charger after cooler, charge air cooler, or EGR.

In embodiments of the present invention, the tube strengthener abuts the tube at a localized contact area, and, tube strengthener plus tube at the localized contact area, form a strengthened joint comprising the tube, the tube strengthener and the header where the tube touches or abuts the header (header joint). The header joint may be brazed to form a brazed header joint.

Fluid, in connection with various aspects of the present invention, can be, for example, gasses such as air or other gasses, liquids such as cooling or cooling automotive fluids, or other fluids, or mixtures of the above.

Figure 1:
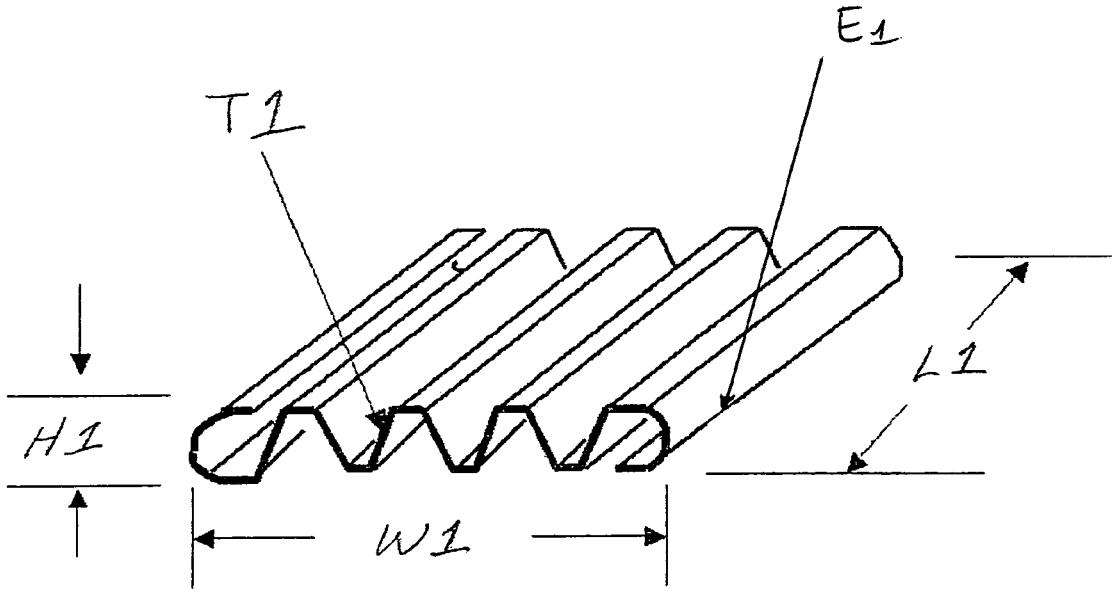
FIG. 1 is an elevational schematic view of a tube strengthener-end contact, in accordance with an aspect of the present invention.

Referring to FIG. 1, a tube strengthener-end contact having an internal dimension and a length (L1) greater than 5 mm and less than ½ length of the tube that can be placed in an oval or oblong or rectangular or dome shaped tube, in accordance with an aspect of the present invention. The number of fins is dependent on the width (W1) of the tube strengthener. The tube strengthener-end contact is of the width (W1) and height (H1) to match the inner dimension of the tube. Material thickness (T1) is greater than of the design internal fin or greater than 25% of the tube wall thickness. The shape and coverage of the end contact (E1) is dependent on the style of tube chosen and the stresses within the heat exchanger.

Figure 2A:
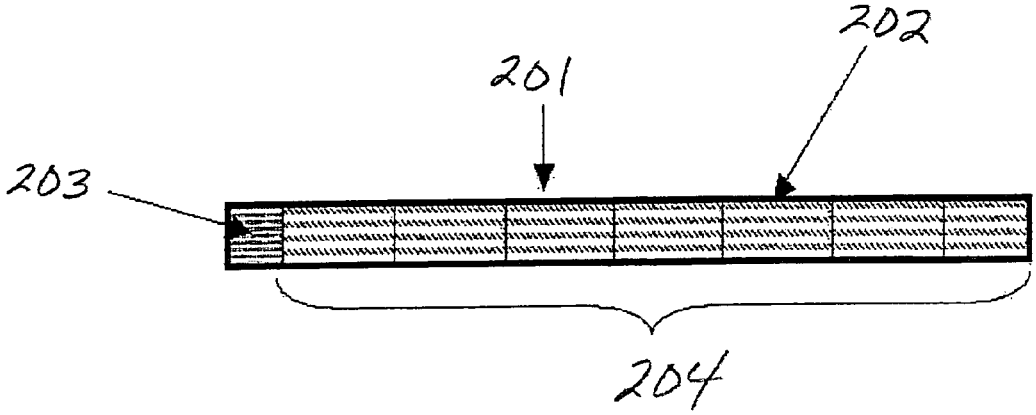
FIG. 2*a* is a schematic top view of internal fin with a tube strengthener in one end of a tube, in accordance with an aspect of the present invention.

Referring to FIG. 2*a* a side view of a tube assembly (201) showing a tube (202) containing a tube strengthener (203) at one end (outermost or final internal fin) with a series of standard internal fin sections (204) is shown. The tube strengthener (203) 'replaces' an outermost internal fin.

Figure 2B:
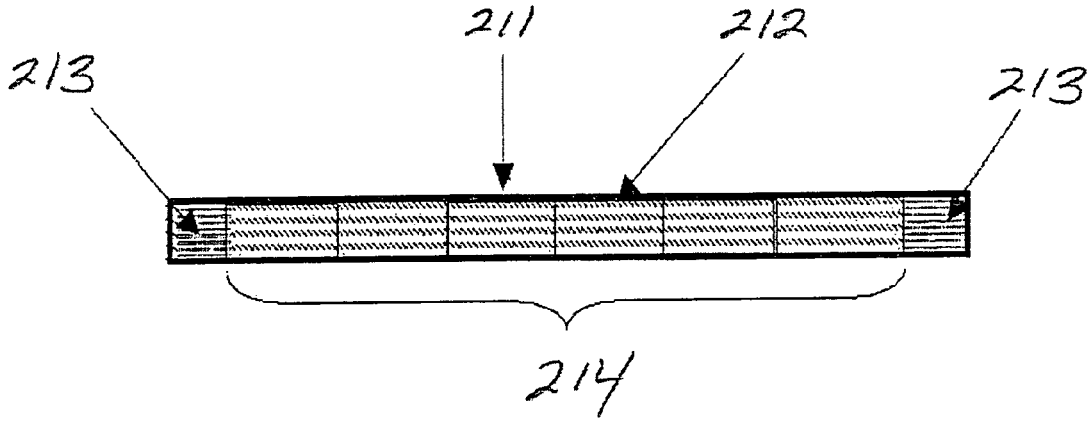
FIG. 2*b* is a cross sectional schematic side view of a tube strengthener in both ends of a tube, in accordance with an aspect of the present invention.

Referring to FIG. 2*b* a side view of a tube assembly (211) showing a tube (212) containing two tube strengtheners (213) at the outer ends with a series of standard internal fin sections (214) in the center. The tube strengtheners (213) 'replaces' the outermost or final internal fins.

Figure 3:
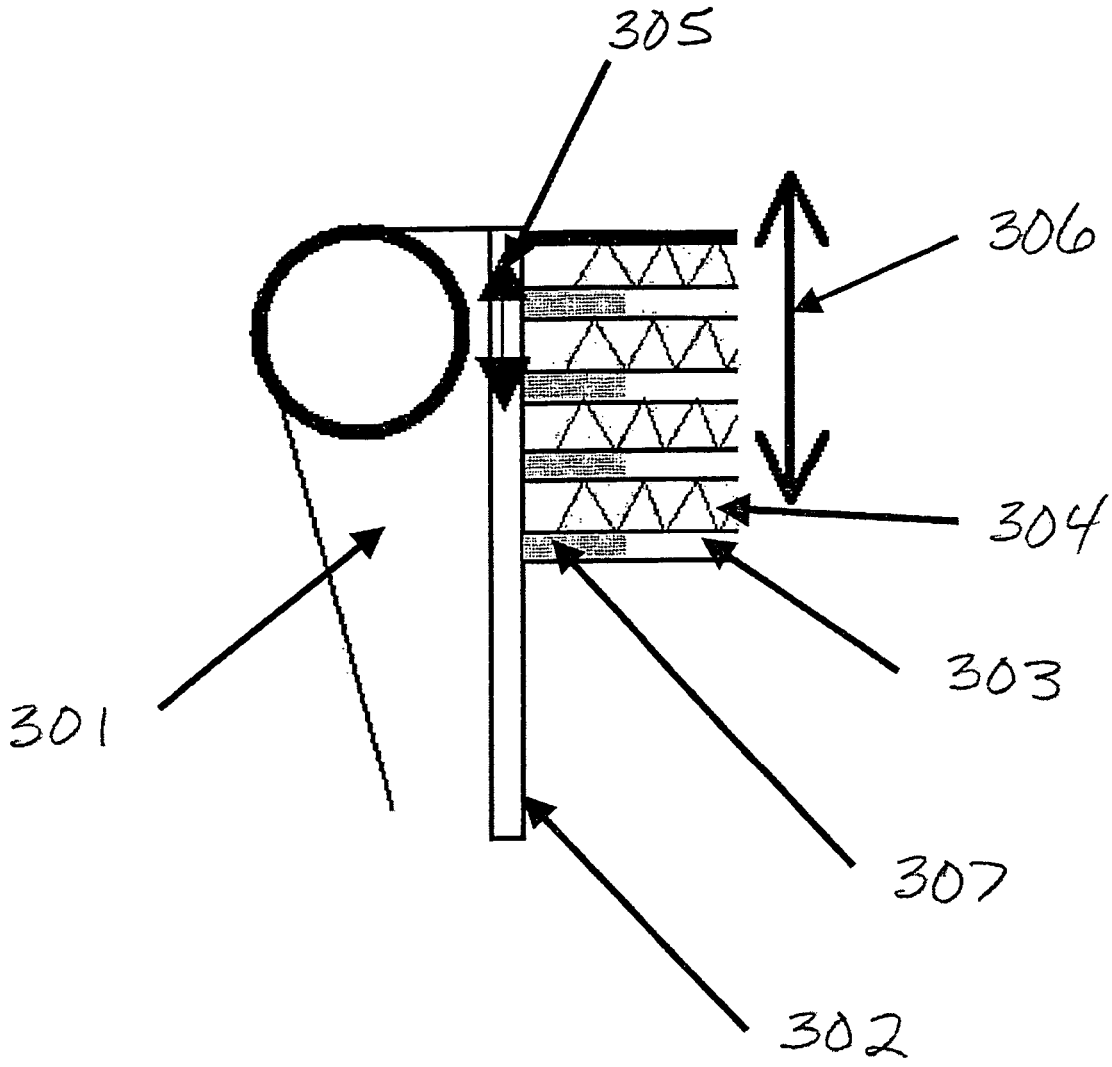
FIG. 3 is a representation of the distribution of stresses from expansion between header and tubes of heat exchanger assemblies showing a potential placement of a tube strengthener.

Referring to FIG. 3 is a representation of the header area of a heat exchanger showing the direction of normal operating stress on a typical charge air cooler and indicating the relative difference in thermal movement between the header thermal stress (305) and the heat exchange portion thermal stress (306). The typical heat exchanger consisting of a tank (301), header (302), air fin (304), tube assembly (303), and tube strengthener (307).

Figure 4A:
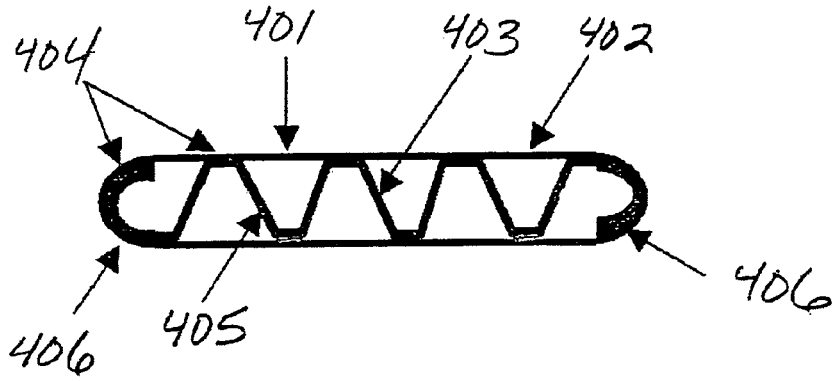
FIG. 4*a-c* is a cross sectional schematic end view of a tube strengthener-end contact in an oval shaped tube, in accordance with an aspect of the present invention.
Figure 4B:
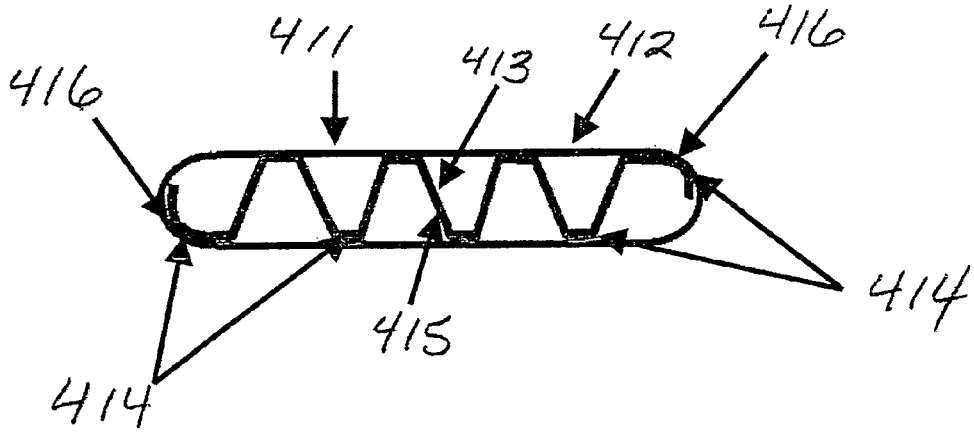
Figure 4C:
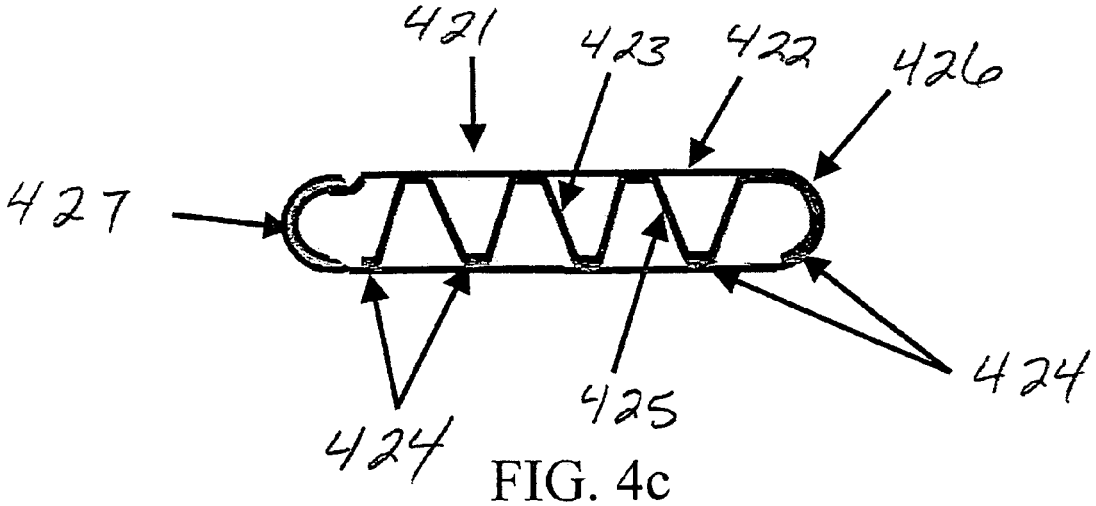

Referring to FIG. 4*a-c*, an oval tube assembly (401,411, 421) is shown with tube (402,412,422) and tube strengthener-end contact (403,413,423). The tube strengthener-end contact consists of the fin (405,415,425) for strength and heat transfer, localized contact surface (404,414,424), and end contact (406,416,426). Preferably the tube strengthener-end contact follows the contour of the inner tube, more preferably, the entire contour of the inner tube provides the localized contact area for the tube strengthener-end contact in the area of contact of the tube strengthener-end contact. Preferably, the tube strengthener-end contact abuts the tube at a localized contact area, and, tube strengthener-end contact plus tube at the localized contact area, form a strengthened joint comprising the tube, the tube strengthener and the header where the tube touches or abuts the header (header joint). The header joint is brazed to form a brazed header joint.

Referring to FIG. 4*a*, the contour of the tube strengthener-end contact is formed such that the end radius (406) contacts the inner wall of the tube, and preferably, contacts the inner wall of the tube at a localized contact surface (404). The contour of the tube strengthener-end contact completely covering the inside tube minor dimension radius, thus forming a strengthened joint when the heat exchanger is brazed.

Referring to FIG. 4*b*, the contour of the tube strengthener-end contact is formed such that the end radius (416) contacts the inner wall of the tube, and preferably, contacts the inner wall of the tube at a localized contact surface (414). The localized contact area abuts part of one outer upper end radius on one side of the tube and part of one outer bottom end radius of the respective tube strengthener-end contact on the opposite inside of the tube, the tube strengthener-end contact, therefore, having contact or abutting only a portion of the inner tube in the area between the inner upper end radius to the bottom end radius of the tube on either end. The contour of the tube strengthener-end contact partially covering the inside tube minor diameter radius, thus forming a strengthened joint when the heat exchanger is brazed, but according to the durability requirements of the heat exchanger.

Referring to FIG. 4*c*, the contour of the tube strengthener-end contact is formed such that the end radius (426) contacts the inner wall of the tube, and preferably, contacts the inner wall of the tube at a localized contact surface (424). The contour of the tube strengthener-end contact covering all or a portion of one inside tube minor dimension radius, thus forming a strengthened joint when the heat exchanger is brazed. The second inside tube minor diameter radius, being a folded tube end (427), and providing a strengthened joint that is supported by the tube strengthener-end contact.

Figure 5A:
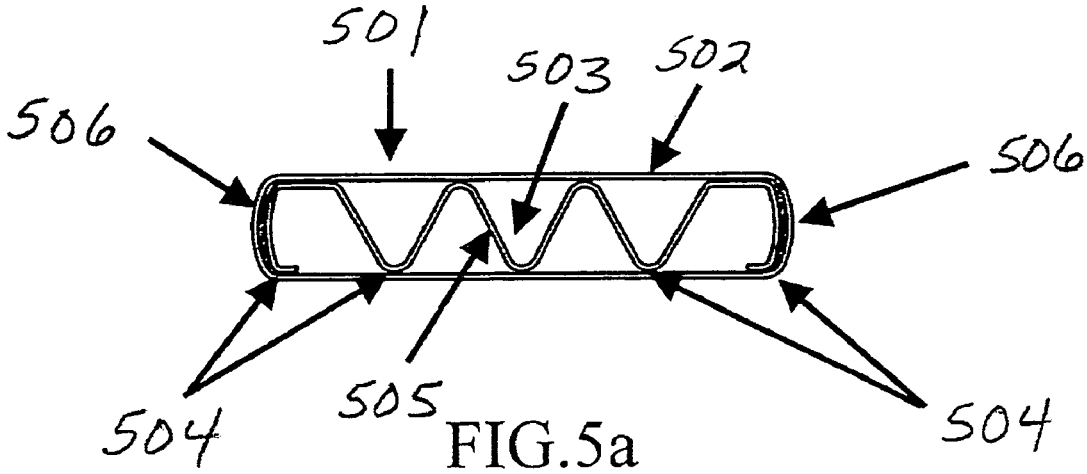
FIG. 5*a-c* is a cross sectional schematic end view of a tube strengthener-end contact in a domed end shaped tube, in accordance with an aspect of the present invention.
Figure 5B:
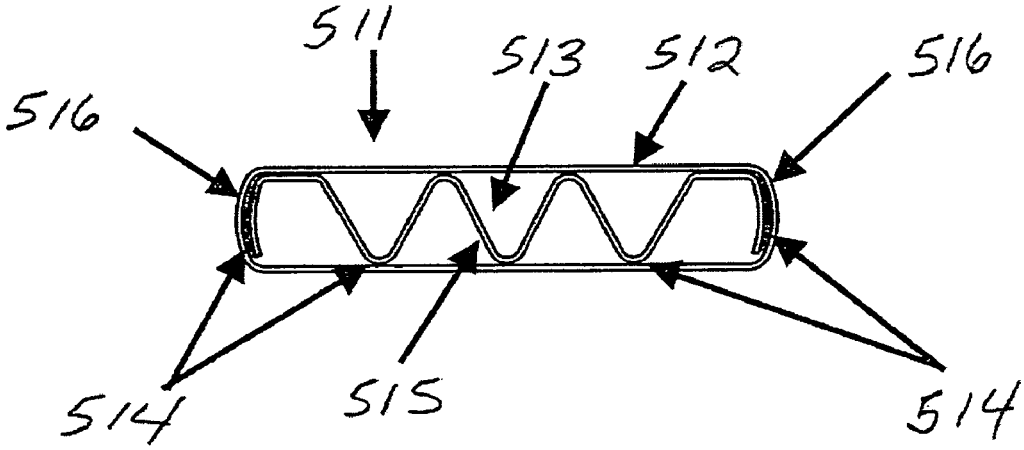
Figure 5C:
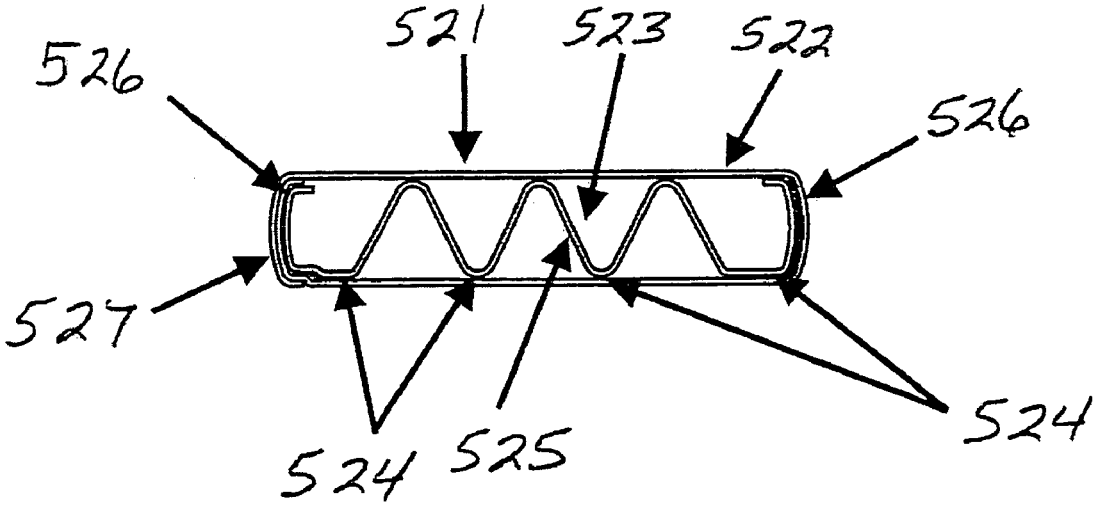

Referring to FIG. 5*a-c*, a domed tube assembly (501,511, 521) is shown with tube (502,512,522) and tube strengthener-end contact (503,513,523). The tube strengthener-end contact consists of the fin (505,515,525) for strength and heat transfer, localized contact surface (504,514,524), and end contact (506,516,526). Preferably the tube strengthener-end contact follows the contour of the inner tube, more preferably, the entire contour of the inner tube provides the localized contact area for the tube strengthener-end contact in the area of contact of the tube strengthener-end contact. Preferably, the tube strengthener-end contact abuts the tube at a localized contact area, and, tube strengthener-end contact plus tube at the localized contact area, form a strengthened joint comprising the tube, the tube strengthener and the header where the tube touches or abuts the header (header joint). The header joint is brazed to form a brazed header joint.

Referring to FIG. 5*a*, the contour of the tube strengthener-end contact is formed such that the end contact (506) radius contacts the inner wall of the tube, and preferably, contacts the inner wall of the tube at a localized contact surface (504). The contour of the tube strengthener-end contact completely covering the inside tube minor dimension radius, thus forming a strengthened joint when the heat exchanger is brazed.

Referring to FIG. 5*b*, the contour of the tube strengthener-end contact is formed such that the end contact (516) radius contacts the inner wall of the tube, and preferably, contacts the inner wall of the tube at a localized contact surface (514). The localized contact area abuts part of one outer upper end radius on one side of the tube and part of one outer bottom end radius of the respective tube strengthener-end contact on the opposite side of the tube, the tube strengthener-end contact, therefore, having contact or abutting only a portion of the inner tube in the area between the inner upper end radius to the bottom end radius of the tube on either end. The contour of the tube strengthener-end contact partially covering the inside tube minor dimension radius, thus forming a strengthened joint when the heat exchanger is brazed, but according to the durability requirements of the heat exchanger.

Referring to FIG. 5*c*, the contour of the tube strengthener-end contact is formed such that the end contact (526) contacts the inner wall of the tube, and preferably, contacts the inner wall of the tube at a localized contact surface (524). The contour of the tube strengthener-end contact covering all or a portion of one inside tube minor dimension radius, thus forming a strengthened joint when the heat exchanger is brazed. The second inside tube minor dimension radius, being a folded tube end (527), and providing a strengthened joint that is supported by the tube strengthener-end contact adjacent to the folded tube end or covering all or a portion or none of the inside tube minor dimension radius.

Referring to FIG. 6*a-d*, a rectangular tube assembly (601, 611,621,631) is shown with tube (602,612,622,632) and tube strengthener-end contact (603,613,623,633). The tube strengthener-end contact consists of the fin (605,615,625, 635) for strength and heat transfer, localized contact surface (604,614,624,634), and end contact (606,616,626,636). Preferably the tube strengthener-end contact follows the contour of the inner tube, more preferably, the entire contour of the inner tube provides the localized contact area for the tube strengthener-end contact in the area of contact of the tube strengthener-end contact. Preferably, the tube strengthener-end contact abuts the tube at a localized contact area, and, tube strengthener-end contact plus tube at the localized contact area, form a strengthened joint comprising the tube, the tube strengthener and the header where the tube touches or abuts the header (header joint). The header joint is brazed to form a brazed header joint.

Figure 6A:
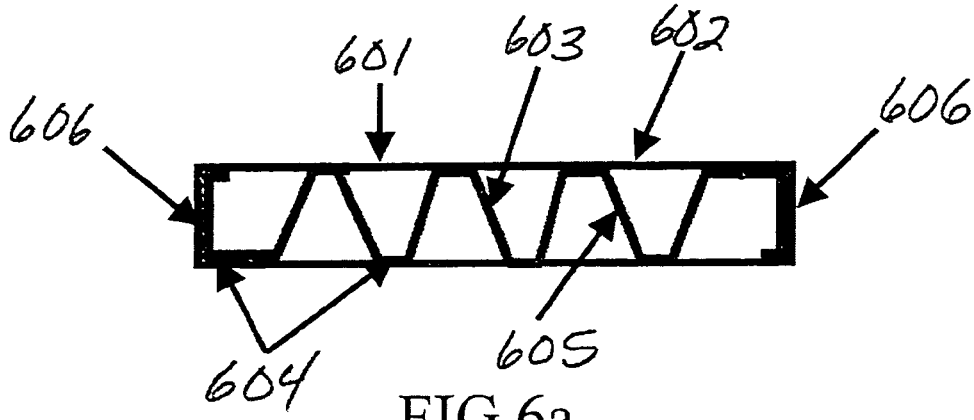
FIG. 6*a-d* is a cross sectional schematic end view of a tube strengthener-end contact in a rectangular shaped tube, in accordance with an aspect of the present invention.

Referring to FIG. 6*a*, the contour of the tube strengthener-end contact is formed such that the end contact (606) contacts the inner wall of the tube, and preferably, contacts the inner wall of the tube at a localized contact surface (604). The contour of the tube strengthener-end contact completely covering the inside tube minor dimension, thus forming a strengthened joint when the heat exchanger is brazed.

Figure 6B:
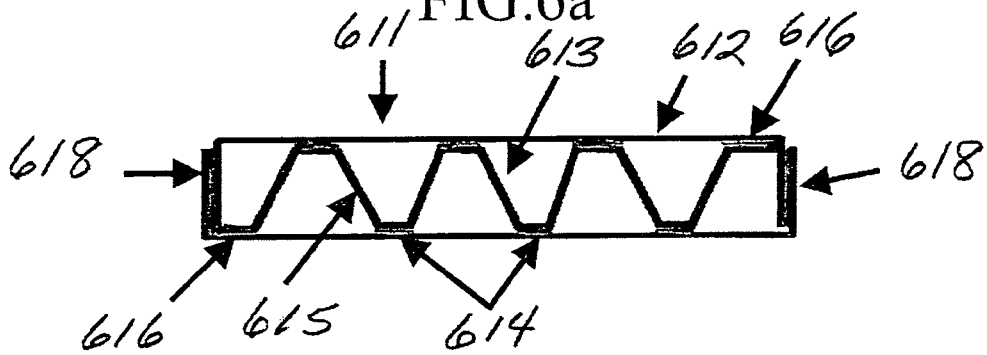

Referring to FIG. 6*b*, the contour of the tube strengthener-end contact is formed such that the end contact (616) contacts the inner wall of the tube, and preferably, contacts the inner wall of the tube at a localized contact area (614). The localized contact area at a minimum abuts part of, or partial or, completely one or both minor tube dimension wall or any combination. The inside tube wall minor dimension, being a nested (618) tube design, and providing a strengthened joint that is supported by the tube strengthener-end contact adjacent to the nested tube end or covering all or a portion or none of the inside tube minor dimension leg.

Figure 6C:
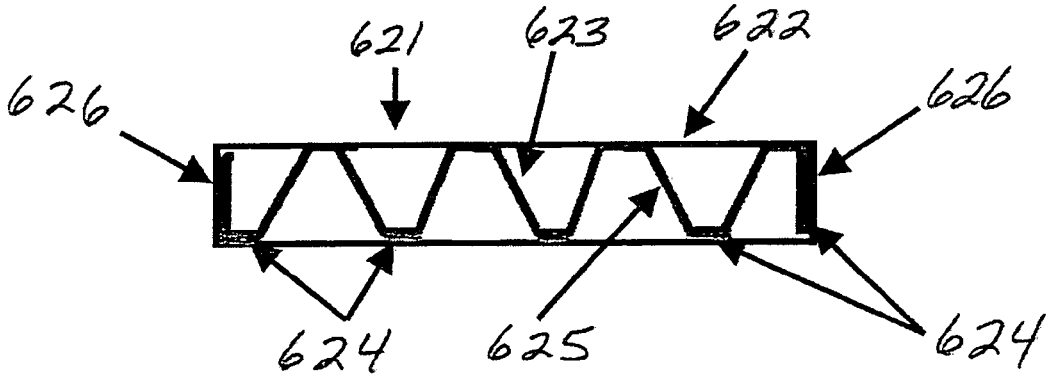

Referring to FIG. 6*c*, the contour of the tube strengthener-end contact is formed such that the end contact (626) contacts the inner wall of the tube, and preferably, contacts the inner all of the tube at a localized contact surface (624). The localized contact area abuts part of one outer upper end contact on one side of the tube and part of one outer bottom end contact of the respective tube strengthener-end contact on the opposite side of the tube, the tube strengthener-end contact, therefore, having contact or abutting only a portion of the inner tube in the area between the inner upper end minor dimension to the bottom end minor dimension of the tube on either end. The contour of the tube strengthener-end contact partially covering the inside tube minor dimension end, thus forming a strengthened joint when the heat exchanger is brazed, but according to the durability requirements of the heat exchanger.

Figure 6D:
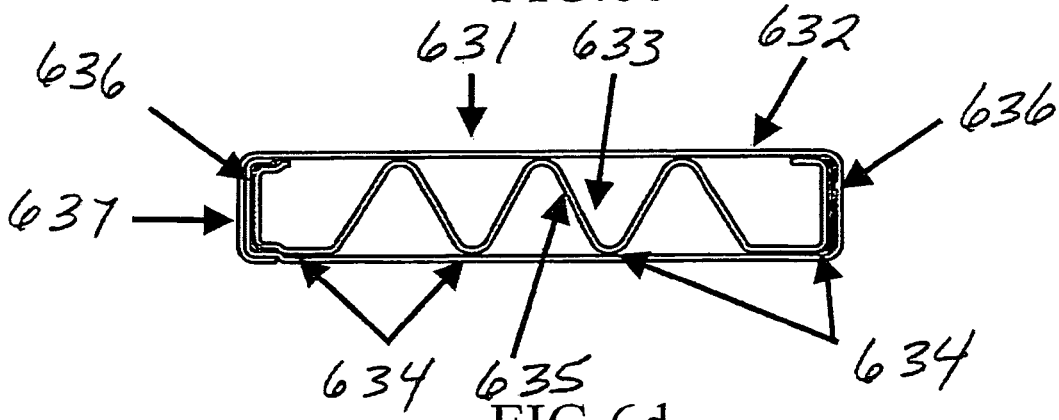

Referring to FIG. 6*d*, the contour of the tube strengthener-end contact is formed such that the end radius (636) contacts the inner wall of the tube, and preferably, contacts the inner wall of the tube at a localized contact surface (634). The contour of the tube strengthener-end contact covering all or a portion of one inside tube minor dimension, thus forming a strengthened joint when the heat exchanger is brazed. The second inside tube minor dimension radius, being a folded tube end (637), and providing a strengthened joint that is supported by the tube strengthener-end contact adjacent to the folded tube end or covering all or a portion of the inside tube minor dimension radius.

Figure 7:
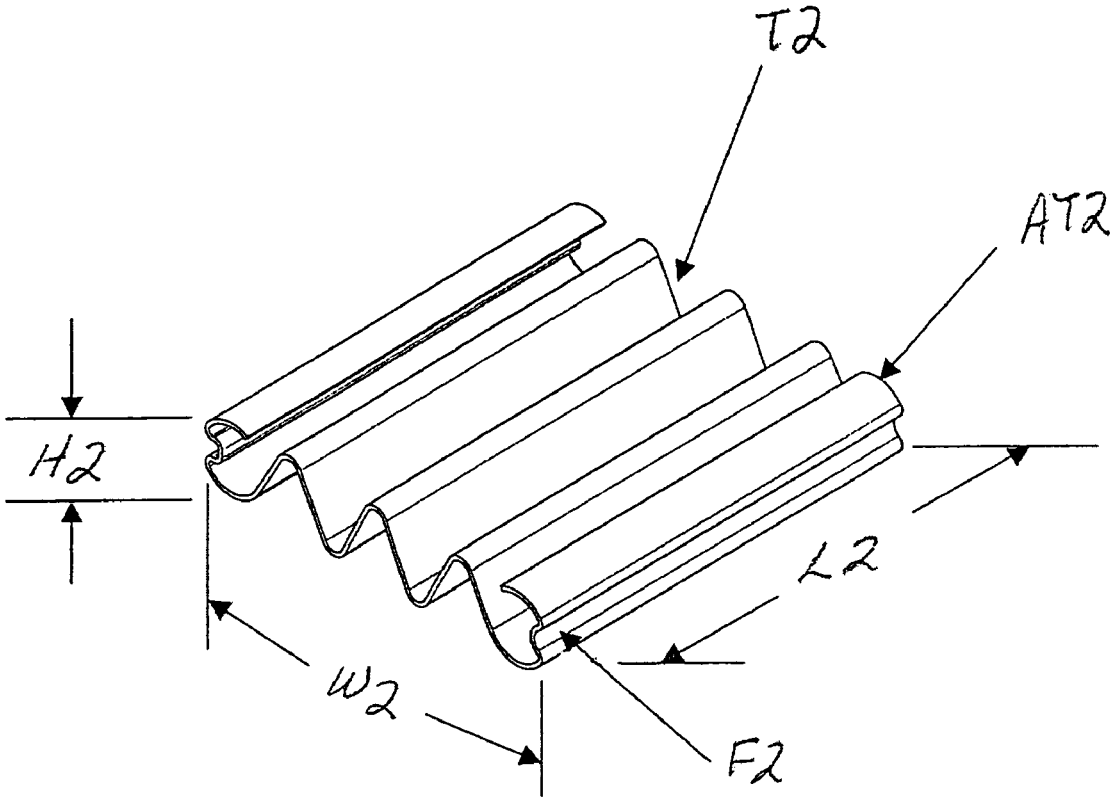
FIG. 7 is an elevational schematic view of a tube strengthener-structural, in accordance with an aspect of the present invention.

Referring to FIG. 7, a tube strengthener-structural having an internal dimension and a length (L2) greater than 5 mm and less than ½ length of the tube that can be placed in an oval or oblong or rectangular or dome shaped tube, in accordance with an aspect of the present invention. The number of fins is dependent on the width (W2) of the tube strengthener. The tube strengthener-structural is of the width (W2) and height (H2) to match the inner dimension of the tube. Material thickness (T2) is greater than of the design internal fin or greater than 25% of the tube wall thickness. One or more formed structure (F2) (fin features or design aspects as described herein above) is located adjacent an additional thickness (AT2) with shape is dependant on space and engineering requirements to resist localized stresses in the tube. A formed structure (F2) is located next to an additional thickness (AT2), with a visible gap between the inside wall of the tube and the outside wall of the tube strengthener-structural. The additional thickness (AT2) brazed contact surface is dependant on the style of tube chosen, stresses within the heat exchanger, and resistance to the localized stresses needed at the point of contact.

Referring to FIG. 8*a-d*, an oval tube assembly (801,811, 821,831) is shown with tube (802,812,822,832) and tube strengthener-structural (803,813,823,833). The tube strengthener-structural consists of the fin (805,815,825,835) for strength and heat transfer, localized contact surface (804, 814,824,834), additional thickness (809,819,829,839), and formed structure (806,807,816,817,826,836,837). A formed structure may be a combination of straight, curved, rectangular fin features or design aspects that are adjacent to an additional thickness area secured by brazing to the inside tube surface, which have a gap between the inside tube surface and the outside surface of the tube strengthener-structural. Preferably the tube strengthener-structural follows the contour of the inner tube, more preferably, the entire contour of the inner tube provides the localized contact area for the tube strengthener-structural in the area of contact of the tube strengthener-structural. Preferably, the tube strengthener-structural abuts the tube at a localized contact area, and, tube strengthener-structural plus tube at the localized contact area, form a strengthened joint comprising the tube, the tube strengthener and the header where the tube touches or abuts the header (header joint). The header joint is brazed to form a brazed header joint.

Figure 8A:
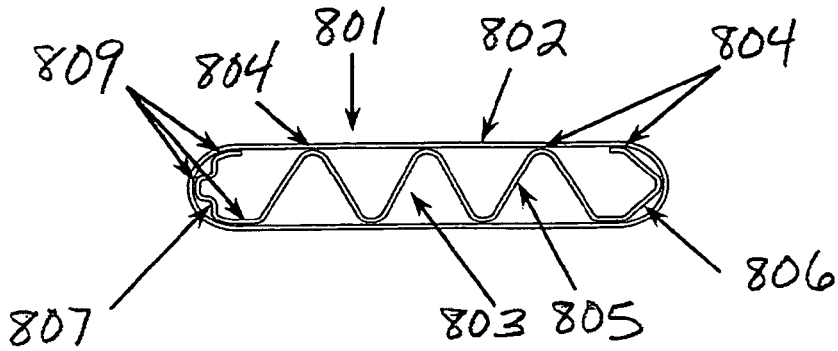
FIGS. 8*a-d* is cross sectional schematic views of tube strengthener-structural in an oval tube, in accordance with an aspect of the present invention

Referring to FIG. 8*a*, in an aspect of the invention there are formed structures (806,807) with additional thickness (809) areas at the tube minor dimension end radius. The contour of the tube strengthener-structural covering the inside tube minor dimension radius with at least three additional thickness (809) and at least two adjacent formed structures (806, 807) for further localized strengthening the tube assembly at the area of greatest stress, thus forming a strengthened joint when the heat exchanger is brazed.

Figure 8B:
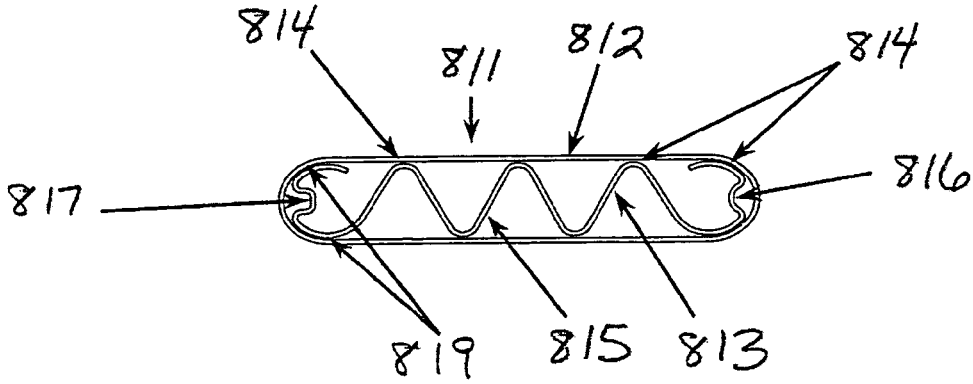

Referring to FIG. 8*b*, in an aspect of the invention there are formed structures (816,817) with additional thickness (819) areas at the tube minor dimension end radius. The contour of the tube strengthener-structural covering the inside tube minor dimension radius with at least two or less additional thickness (819) and at least one adjacent formed structures (816,817) for further localized strengthening the tube assembly at the area of greatest stress, thus forming a strengthened joint when the heat exchanger is brazed.

Figure 8C:
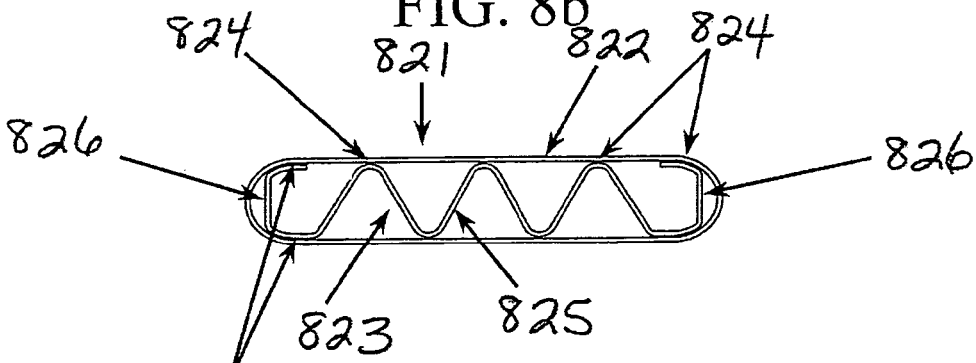

Referring to FIG. 8*c*, in an aspect of the invention the formed structure (826) with additional thickness (829) areas at the tube minor dimension end radius. The contour of the tube strengthener-structural covering the inside tube minor dimension radius with at least two or less additional thickness (829) and at least one adjacent formed structures (826) for further localized strengthening the tube assembly at the area of greatest stress, thus forming a strengthened joint when the heat exchanger is brazed. The formed structure consisting of a portion of the tube strengthener-structural that is straight and approximately perpendicular from the tube major dimension surface.

Figure 8D:
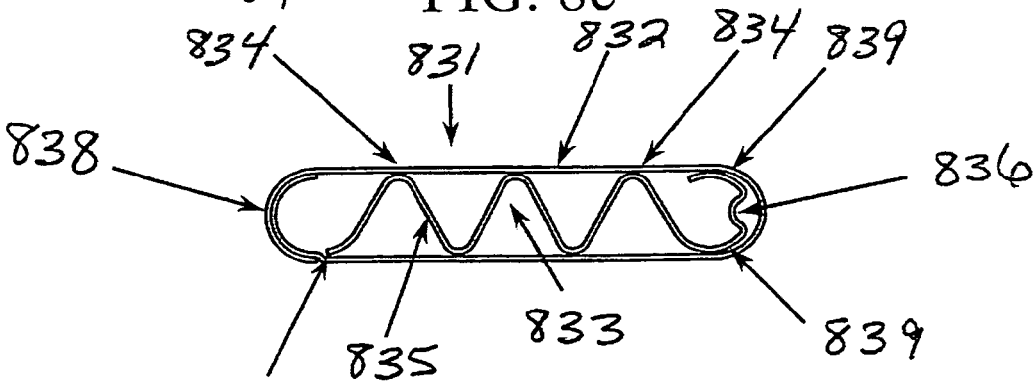

Referring to FIG. 8*d*, in an aspect of the invention there are formed structures (836,837) with additional thickness (839) areas at the tube minor dimension end radius. One side of the inside tube minor dimension radius, being a folded tube end (838), and providing a strengthened joint that is supported by the tube strengthener-structural. The localized contact area (834) at a minimum abuts part of, or partial, or completely the minor tube dimension wall of the folded tube (838) and is supported by the formed structure (837) adjacent to covering all or a portion or none of the inside folded tube minor dimension leg. The contour of the tube strengthener-structural covering the inside tube minor dimension radius with at least two or less additional thickness (839) and at least one adjacent formed structure (836,837) for further localized strengthening the tube assembly at the area of greatest stress, thus forming a strengthened joint when the heat exchanger is brazed.

Figure 9A:
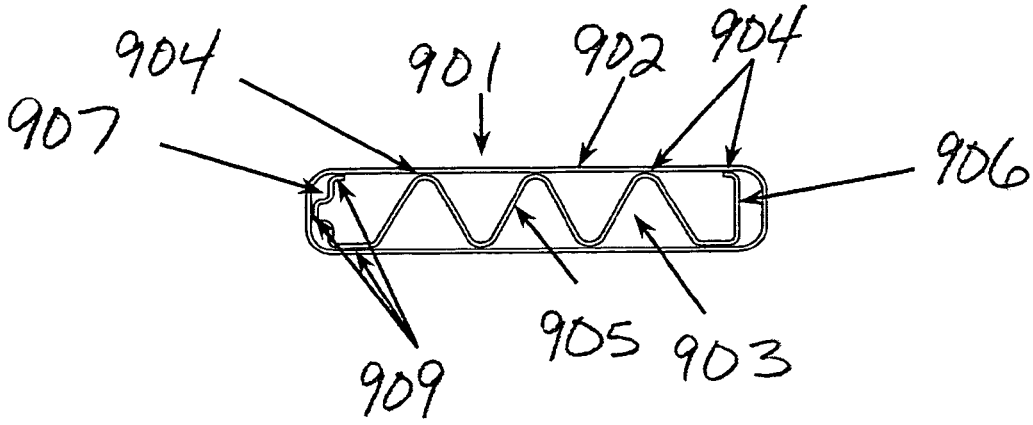
FIGS. 9*a-c* is cross sectional schematic views of tube strengthener-structural in a rectangular tube, in accordance with an aspect of the present invention.
Figure 9B:
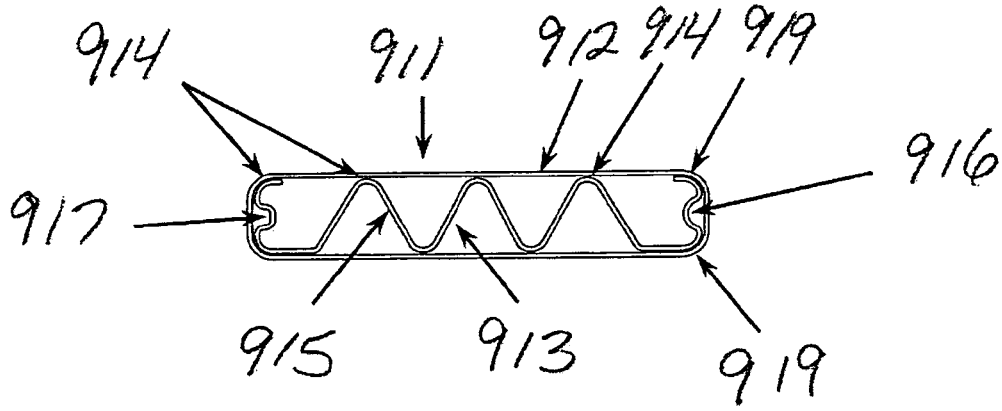
Figure 9C:
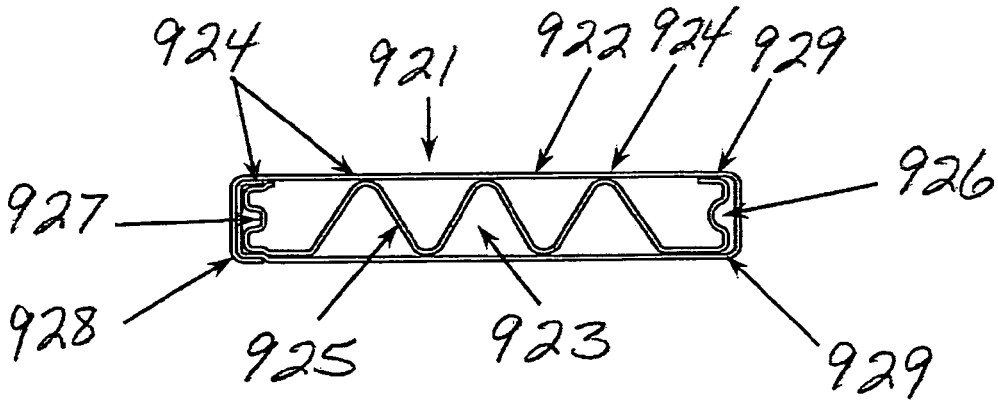

Referring to FIG. 9*a-c*, a rectangular tube assembly (901, 911,921) is shown with tube (902,912,922) and tube strengthener-structural (903,913,923). The tube strengthener-structural consists of the fin (905,915,925) for strength and heat transfer, localized contact surface (904,914,924), additional thickness (909,919,929), and formed structure (906,907,916, 917,926,927). A formed structure may be a combination of straight, curved, rectangular features that are adjacent to, an additional thickness area secured by brazing to the inside tube surface, which have a gap between the inside tube surface and the outside surface of the tube strengthener-structural. Preferably the tube strengthener-structural follows the contour of the inner tube, more preferably, the entire contour of the inner tube provides the localized contact area for the tube strengthener-structural in the area of contact of the tube strengthener-structural. Preferably, the tube strengthener-structural abuts the tube at a localized contact area, and, tube strengthener-structural plus tube at the localized contact area, form a strengthened joint comprising the tube, the tube strengthener and the header where the tube touches or abuts the header (header joint). The header joint is brazed to form a brazed header joint.

Referring to FIG. 9*a*, in an aspect of the invention there are formed structures (906,907) with additional thickness (909) areas at the tube end minor dimension. The contour of one end of the tube strengthener-structural covering the inside tube minor dimension radius with at least three additional thickness (909) and at least two adjacent formed structure (907). The contour of one end of the tube strengthener-structural that is straight and approximately perpendicular from the tube major dimension surface. The tube strengthener-structural utilizing either one or both of the formed structures according to the resistance to stress required in the tube assembly, thus forming a strengthened joint when the heat exchanger is brazed.

Referring to FIG. 9*b*, in an aspect of the invention there are formed structures (916,917) with additional thickness (919) areas at the tube minor dimension end. The contour of the tube strengthener-structural covering the inside tube minor dimension, with at least two or less additional thickness (919) and at least one adjacent formed structures (916,917) for further localized strengthening the tube assembly at the area of greatest stress, thus forming a strengthened joint when the heat exchanger is brazed.

Referring to FIG. 9*c*, in an aspect of the invention there are formed structures (926,927) with additional thickness (929) areas at the tube end minor dimension. One side of the inside tube end minor dimension, being a folded tube end (928), and providing a strengthened joint that is supported by the tube strengthener-structural. The localized contact area (924) at a minimum, abuts part of, or partial, or completely, the minor tube dimension wall of the folded tube (928) and is supported by the folded structure (927) adjacent to covering all or a portion or none of the inside folded tube minor dimension leg. The contour of the tube strengthener-structural covering the inside tube end minor dimension with at least two or less additional thickness (929) and at least one adjacent formed structure (926,927) for further localized strengthening the tube assembly at the area of greatest stress, thus forming a strengthened joint when the heat exchanger is brazed.

Figure 10A:
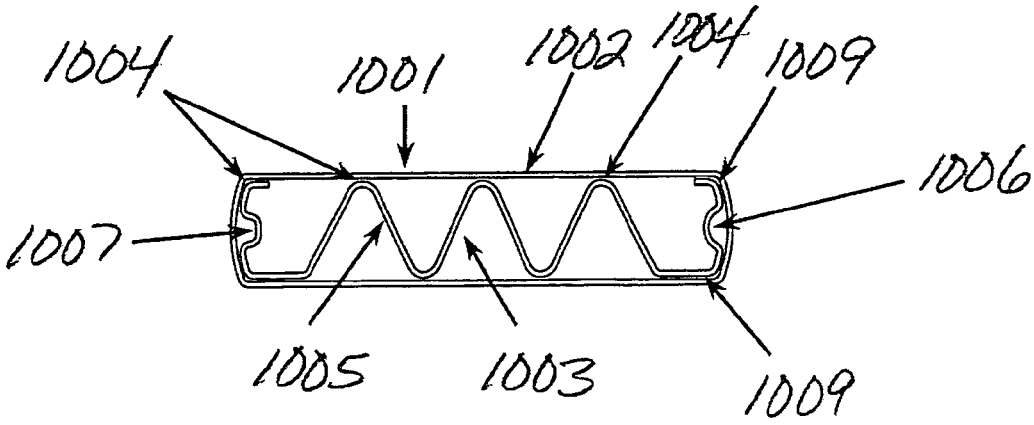
FIGS. 10*a-c* is cross sectional schematic views of tube strengthener-structural in a domed tube, in accordance with an aspect of the present invention.
Figure 10B:
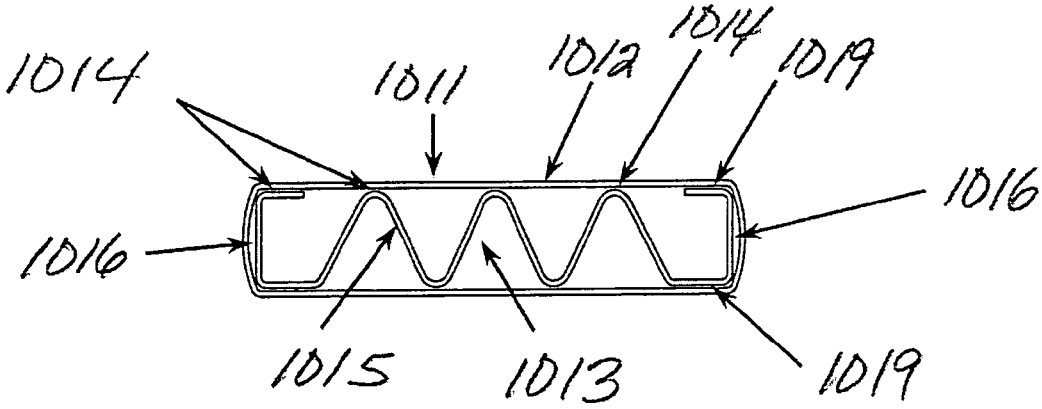
Figure 10C:
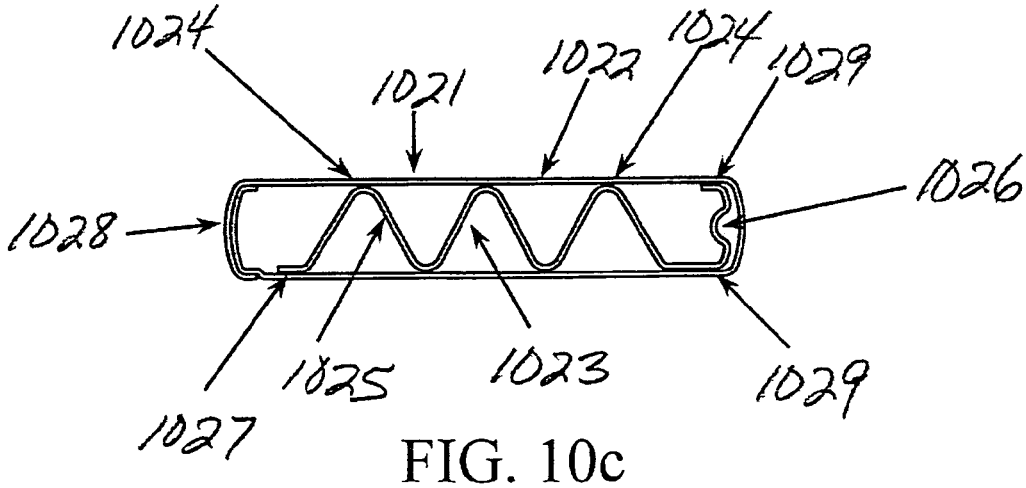

Referring to FIG. 10*a-c*, a domed tube assembly (1001, 1011,1021) is shown with tube (1002,1012,1022) and tube strengthener-structural (1003,1013,1023). The tube strengthener-structural consists of the fin (1005,1015,1025) for strength and heat transfer, localized contact surface (1004, 1014,1024), additional thickness (1009,1019,1029), and formed structure (1006,1007,1016,1017,1026,1027). A formed structure may be a combination of straight, curved, rectangular features that are adjacent to, an additional thickness area secured by brazing to the inside tube surface, which have a gap between the inside tube surface and the outside surface of the tube strengthener-structural. Preferably the tube strengthener-structural follows the contour of the inner tube, more preferably, the entire contour of the inner tube, and provides a localized contact area for the tube strengthener-structural in the area of contact of the tube strengthener-structural. Preferably, the tube strengthener-structural abuts the tube at a localized contact area, and, tube strengthener-structural plus tube at the localized contact area, form a strengthened joint comprising the tube, the tube strengthener and the header where the tube touches or abuts the header (header joint). The header joint is brazed to form a brazed header joint.

Referring to FIG. 10*a*, in an aspect of the invention there are formed structures (1006,1007) with additional thickness (1009) areas at the tube minor dimension end radius. The contour of the tube strengthener-structural covering the inside tube minor dimension radius with at least two additional thickness (1009) and at least one adjacent formed structure (1006,1007) for further localized strengthening the tube assembly at the area of greatest stress. This is a largely strengthened joint when the heat exchanger is brazed.

Referring to FIG. 10*b*, in an aspect of the invention the formed structure (1016) with additional thickness (1019) areas at the tube minor dimension end radius. The contour of the tube strengthener-structural covering the inside tube minor dimension radius with at least two or less additional thickness (1019) and at least one adjacent formed structures (1016) for further localized strengthening the tube assembly at the area of greatest stress. This is a largely strengthened joint when the heat exchanger is brazed. The formed structure consisting of a portion of the tube strengthener-structural that is straight and approximately perpendicular from the tube major dimension surface.

Referring to FIG. 10*c*, in an aspect of the invention there are formed structures (1026,1027) with additional thickness (1029) areas at the tube minor dimension end radius. One side of the inside tube minor dimension radius, being a folded tube end (1028), and providing a strengthened joint that is supported by the tube strengthener-structural. The localized contact area (1024) at a minimum, abuts part of, or partial, or completely the minor tube dimension wall of the folded tube (1028) and is supported by the folded structure (1027) adjacent to covering all or a portion or none of the inside folded tube minor dimension leg thus forming a strengthened joint when the heat exchanger is brazed. The other tube end minor dimension radius uses the contour of the tube strengthener-structural covering the inside tube minor dimension radius with at least two or less additional thickness (1029) and at least one adjacent formed structure (1026) for further localized strengthening the tube assembly at the area of greatest stress. This is a largely strengthened joint when the heat exchanger is brazed.

Figure 11:
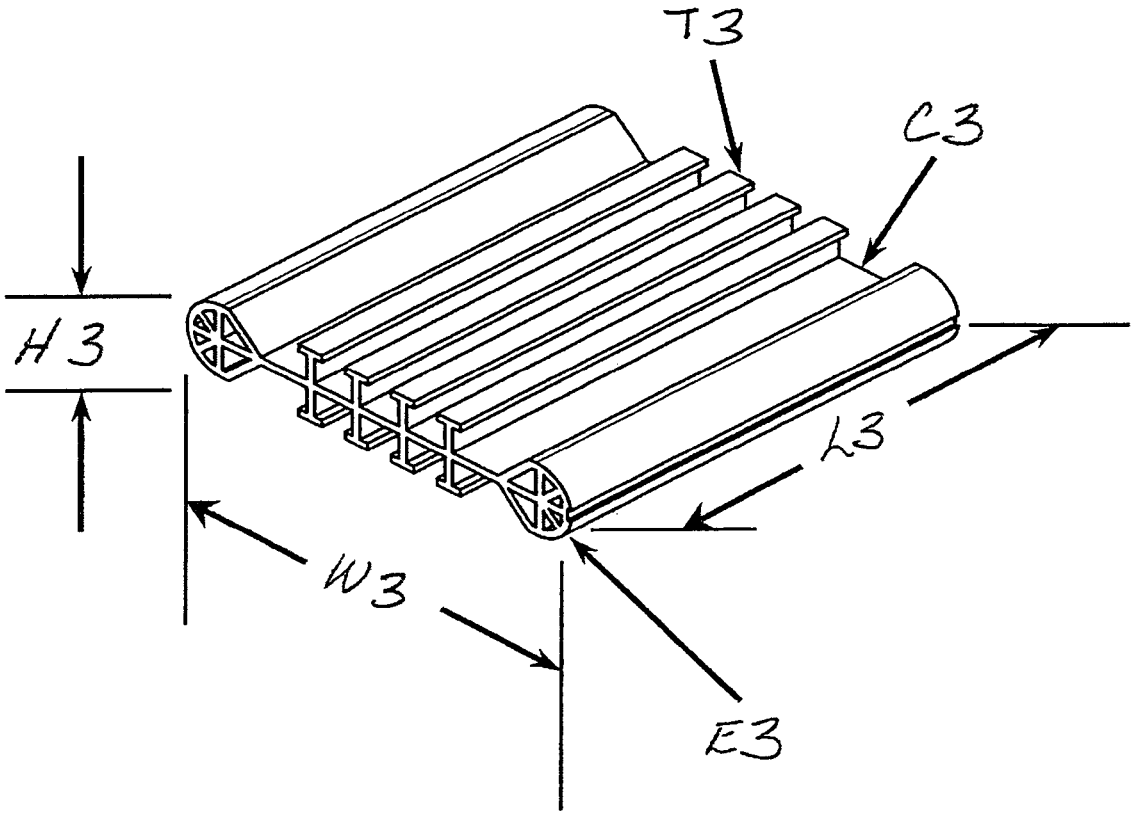
FIG. 11 is an elevational schematic end view of a tube strengthener-extruded, in accordance with an aspect of the present invention.

Referring to FIG. 11, a tube strengthener-extruded having an internal dimension and a length (L3) greater than 5 mm and less than ½ length of the tube that can be placed in an oval or oblong or rectangular or dome shaped tube, in accordance with an aspect of the present invention. All structures protrude from a central web (C3) with the outside surface of those structures brazed to the inside surface of tube. The structures off the central web (C3) may vary in thickness when compared with each other according to the operational stress requirements. The number of fins is dependent on the width (W3) of the tube strengthener. The tube strengthener-extruded is of the width (W3) and height (H3) to match the inner dimension of the tube. Material thickness (T3) is greater, equal to, less, than of the design internal fin or greater than 25% of the tube wall thickness, with different cross sectional thickness throughout the tube strengthener-extruded according to the cross sectional stresses in the tube assembly. One or more extruded structures (E3) is located in the tube end minor dimension radius with shape, thickness and number of stiffening members dependent on engineering requirements to resist localized stresses in the tube.

Figure 12A:
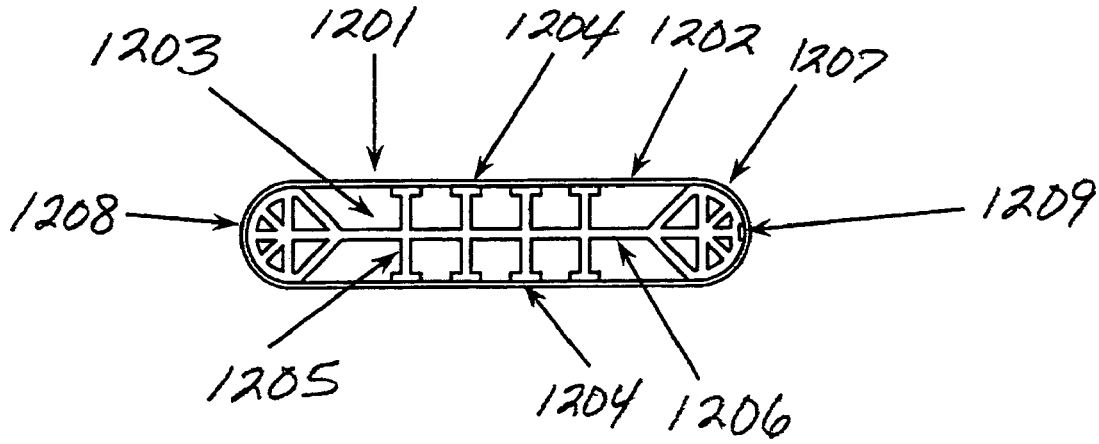
FIG. 12*a-b* is a cross sectional schematic of end view of a tube strengthener-extruded in an oval tube, in accordance with an aspect of the present invention.
Figure 12B:
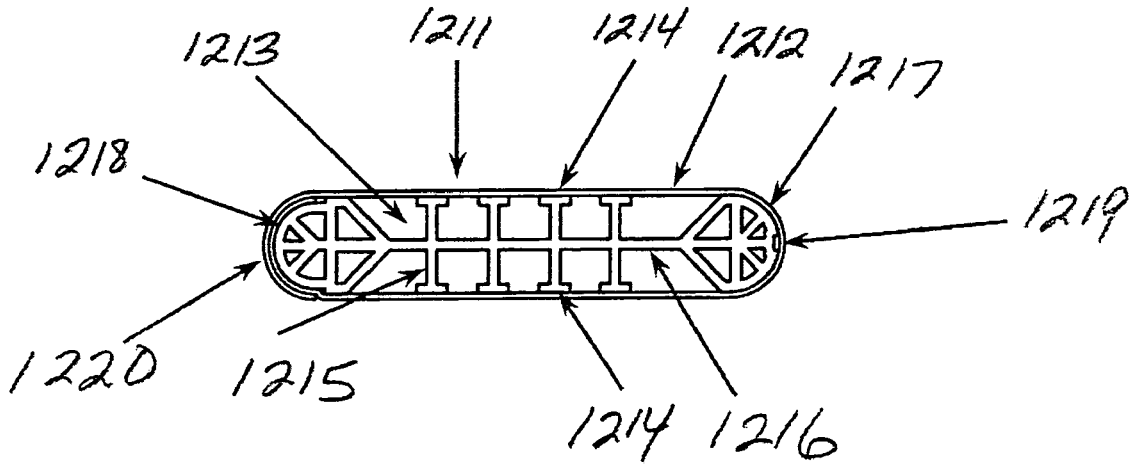

Referring to FIG. 12*a-b* an oval tube assembly (1201,1211) is shown with tube (1202,1212) and tube strengthener-extruded (1203,1213). The tube strengthener-extruded consists of the fin (1205,1215) for strength and heat transfer, localized contact surface (1204,1214), optional flux groove (1209,1219) optional, central web (1206,1216) and extruded structure (1207,1208,1217,1218). The central web is the base structure from which all other elements, (such as, fins, structure, flux grooves, of the tube strengthener-extruded) project with the outside surfaces contacting the inside surface of the tube wall. These features may be in a combination of straight, curved, rectangular features with the outside terminus against the tube interior wall. The tube strengthener-extruded may follow the contour of the inner tube, and/or, the entire contour of the inner tube provides the localized contact area for the tube strengthener-extruded in the area of contact of the tube strengthener-extruded. The tube strengthener-extruded may abuts the tube at a localized contact area, and, tube strengthener-extruded plus tube at the localized contact area, form a strengthened joint comprising the tube, the tube strengthener-extruded and the header where the tube touches or abuts the header (header joint). The header joint is brazed to form a brazed header joint.

Referring to FIG. 12*a*, in an aspect of the invention there are extruded structure (1207,1208) approximately centered about the central web (1206) providing strength in the locations of highest stress, normally the tube end minor dimension radius. Additionally, fins (1205) with localized contact surface (1204) projections contact the tube inside surface on the major dimension. The contour of the tube strengthener-extruded covering none, or part of, or all of, the inside tube minor dimension radius with an extruded structure, a flux groove (1209) is optional, with localized contact surfaces, thus forming a strengthened joint when the heat exchanger is brazed.

Referring to FIG. 12*b*, in an aspect of the invention there are extruded structure (1217,1218) approximately centered about the central web (1216) providing strength in the locations of highest stress, normally the tube end minor dimension radius. Additionally, fins (1215) with localized contact surface (1214) projections contact the tube inside surface on the major dimension. One side of the inside tube minor dimension radius, being a folded tube end (1220), and providing a strengthened joint that is supported by the tube strengthener-structural. The localized contact area (1214) abuts part of, or partial, or completely, the minor tube dimension wall of the folded tube (1220) and is supported by the extruded structure (1218) adjacent to covering all or a portion or none of the inside folded tube minor dimension leg. The contour of the tube strengthener-extruded covering none, or part of, or all of, the inside tube minor dimension radius with an extruded structure, a flux groove (1219) is optional, with localized contact surfaces then forming a single strengthened assembly by brazing.

Figure 13A:
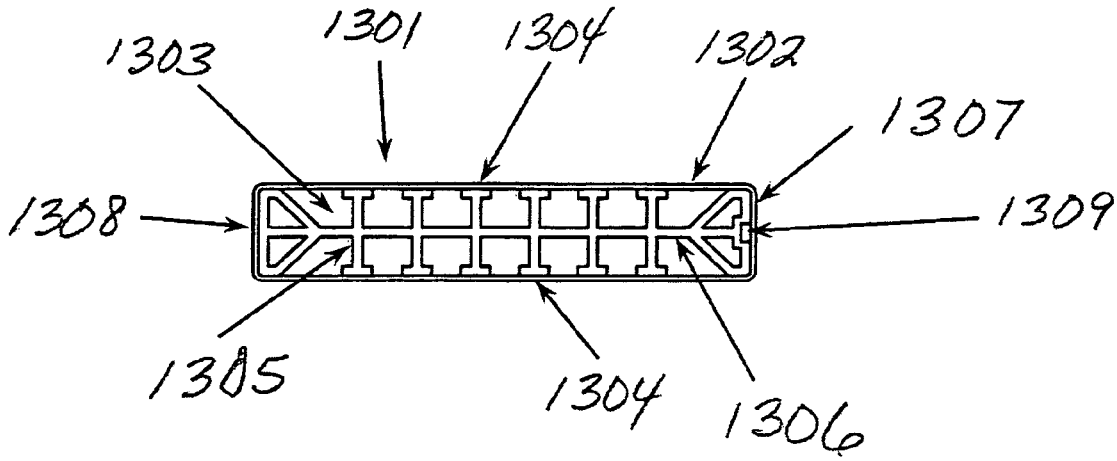
FIG. 13*a-b* is cross sectional end view of a tube strengthener-extruded in a rectangular tube, in accordance with an aspect of the present invention.
Figure 13B:
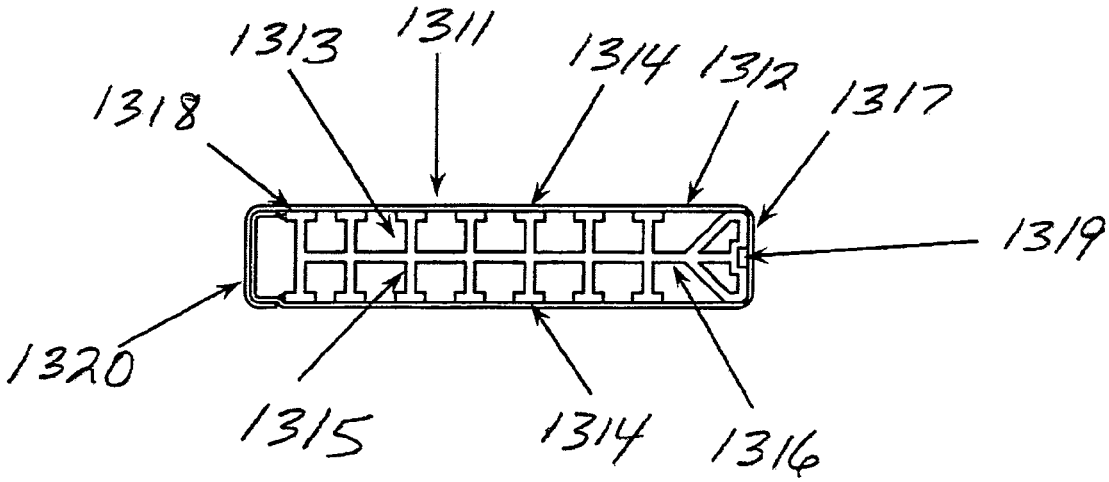

Referring to FIG. 13*a-b* a rectangular tube assembly (1301, 1311) is shown with tube (1302,1312) and tube strengthener-extruded (1303,1313). The tube strengthener-extruded consists of the fin (1305,1315) for strength and heat transfer, localized contact surface (1304,1314), optional flux groove (1309,1319) optional, central web (1306,1316) and extruded structure (1307,1308,1317,1318). The central web is the base structure from which all other elements, such as, fins, structure, flux grooves, of the tube strengthener-extruded, project with the outside surfaces contacting the inside surface of the tube wall. These features may be in a combination of straight, curved, rectangular features with the outside terminus against the tube interior wall. The tube strengthener-extruded may follow the contour of the inner tube, or, the entire contour of the inner tube provides the localized contact area for the tube strengthener-extruded in the area of contact of the tube strengthener-extruded. The tube strengthener-extruded in one aspect of the present invention abuts the tube at a localized contact area, and, tube strengthener-extruded plus tube at the localized contact area, form a strengthened joint comprising the tube, the tube strengthener-extruded and the header where the tube touches or abuts the header (header joint). The header joint is brazed to form a brazed header joint.

Referring to FIG. 13*a*, in an aspect of the invention there are extruded structure (1307,1308) approximately centered about the central web (1306) providing strength in the locations of highest stress, normally the tube end minor dimension. Additionally, fins (1305) with localized contact surface (1304) projections contact the tube inside surface on the major dimension. The contour of the tube strengthener-extruded covering none, or part of, or all of, the inside tube minor dimension with an extruded structure, a flux groove (1309) is optional, with localized contact surfaces, thus forming a strengthened joint when the heat exchanger is brazed.

Referring to FIG. 13*b*, in an aspect of the invention there are extruded structure (1317,1318) approximately centered about the central web (1316) providing strength in the locations of highest stress, normally the tube end minor dimension. Additionally, fins (1315) with localized contact surface (1314) projections contact the tube inside surface on the major dimension. One side of the inside tube minor dimension, being a folded tube end (1320), and providing a strengthened joint that is supported by the tube strengthener-structural. The localized contact area (1314) abuts part of, or partial, or completely the minor tube dimension wall of the folded tube (1320) and is supported by the extruded structure (1318) adjacent to covering all or a portion or none of the inside folded tube minor dimension leg. The contour of the tube strengthener-extruded covering none, or part of, or all of, the inside tube minor dimension radius with an extruded structure, a flux groove (1319) is optional, with localized contact surfaces then forming a single strengthened assembly by brazing.

Figure 14A:
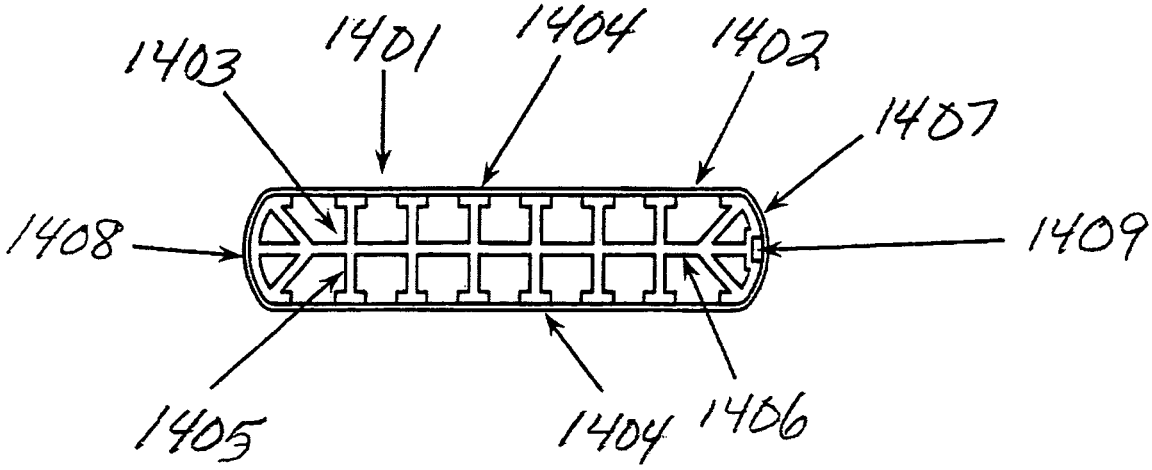
FIG. 14*a-b* is a cross sectional schematic view of a internal fin with end views of a tube strengthener-extruded in a domed tube, in accordance with an aspect of the present invention.
Figure 14B:
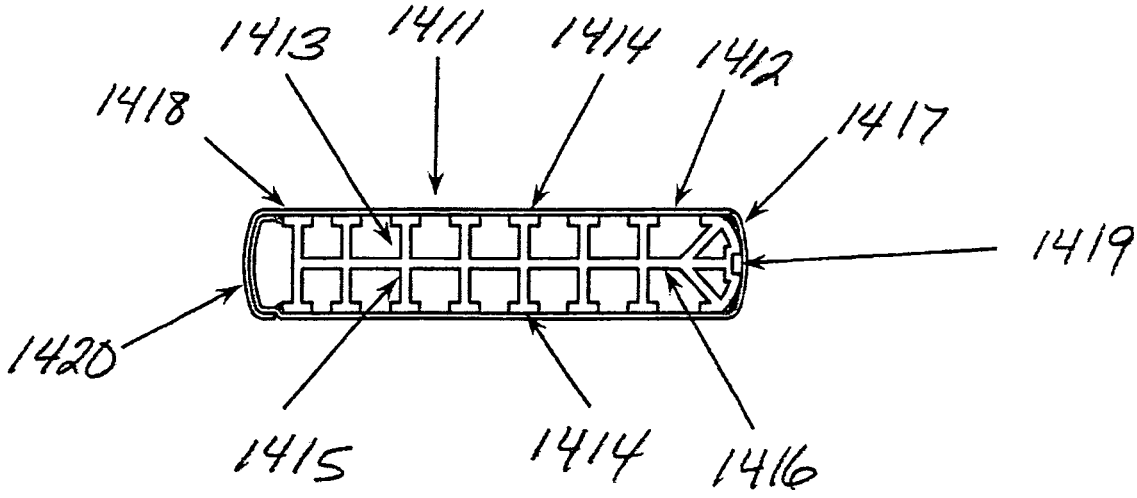

Referring to FIG. 14*a-b* a domed tube assembly (1401, 1411) is shown with tube (1402,1412) and tube strengthener-extruded (1403,1413). The tube strengthener-extruded consists of the fin (1405,1415) for strength and heat transfer, localized contact surface (1404,1414), optional flux groove (1409,1419) optional, central web (1406,1416) and extruded structure (1407,1408,1417,1418). The central web is the base structure from which all other elements, such as, fins, structure, flux grooves, of the tube strengthener-extruded project with the outside surfaces contacting the inside surface of the tube wall. The feature may be in a combination of straight, curved, rectangular features with the outside terminus against the tube interior wall. Preferably the tube strengthener-extruded follows the contour of the inner tube, more preferably, the entire contour of the inner tube provides the localized contact area for the tube strengthener-extruded in the area of contact of the tube strengthener-extruded. Preferably, the tube strengthener-extruded abuts the tube at a localized contact area, and, tube strengthener-extruded plus tube at the localized contact area, form a strengthened joint comprising the tube, the tube strengthener-extruded and the header where the tube touches or abuts the header (header joint). The header joint is brazed to form a brazed header joint.

Referring to FIG. 14*a*, in an aspect of the invention there are extruded structure (1407,1408) approximately centered about the central web (1406) providing strength in the locations of highest stress, normally the tube end minor dimension radius. Additionally, fins (1405) with localized contact surface (1404) projections contact the tube inside surface on the major dimension. The contour of the tube strengthener-extruded covering none, or part of, or all of, the inside tube minor dimension radius with an extruded structure, a flux groove (1409) is optional, with localized contact surfaces, thus forming a strengthened joint when the heat exchanger is brazed.

Referring to FIG. 14*b*, in an aspect of the invention there are extruded structure (1417,1418) approximately centered about the central web (1416) providing strength in the locations of highest stress, normally the tube end minor dimension radius. Additionally, fins (1415) with localized contact surface (1414) projections contact the tube inside surface on the major dimension. One side of the inside tube minor dimension radius, being a folded tube end (1420), and providing a strengthened joint that is supported by the tube strengthener-structural. The localized contact area (1414) at a minimum abuts part of, or partial, or completely the minor tube dimension wall of the folded tube (1420) and is supported by the extruded structure (1418) adjacent to covering all or a portion or none of the inside folded tube minor dimension leg. The contour of the tube strengthener-extruded covering none, or part of, or all of, the inside tube minor dimension radius with an extruded structure, a flux groove (1419) is optional, with localized contact surfaces then forming a single strengthened assembly by brazing.

Aspects of the present invention are variable as it relates to size, length, thickness and number of fins that are used to form tube strengtheners and their exact geometric shape may vary dependent on the actual heat exchanger assembly and application and tube design of the assembly. In high stress environmental applications, the overall thickness of the tube wall and tube strengthener may vary, for example, specific charge air cooler applications and tube design may vary.

In heat exchangers with stressful temperature/pressure operating conditions, aspects of the present invention having tube strengthener are beneficial, for example, in CAC designs. Such aspects can be applied with minimal additional labor and only minor modification one manufacturing operations. In various aspects of a method of the present invention, an automated tube stuffer (an automated means or machine of insertion of a turbulator or fin into a tube) can be applied. In such applications, the strengthener can be the first or the last internal fin inserted in the tube, and, therefore, provide for ease of production. In aspects of the invention having a tube strengthener using extruded internal fin or internal fin, the use of extrusion dies gives flexibility to the engineer or designer in designing the extruded internal fin or internal fin so that appropriate strength under stressful environmental operating conditions is obtained with a minimum of material and structure, focalized at the location or locations of minimal stress is needed, as well as allowing the designer the flexibility to add structure and material at the locations of highest stress as appropriate.

The man of ordinary skill in the art will recognize that the relative size, length, thickness and number of fins and exact geometric shape of a heat exchanger assembly in accordance with the present invention, may vary depending on the heat exchanger application used, (e.g. radiator, condenser, after cooler, or charge air cooler, air to oil cooler, exhaust gas recirculation cooler (ERG)), and tube design.

In aspects of the present invention, a method of making a heat exchanger comprising a tube, internal fin or fins, a tube strengthener or strengtheners, and comprising the steps of: forming a internal fin or fins with a tube strengthener or strengtheners; stuffing the internal fin or fins with fin strengthener strengtheners into the tube; localizing the tube strengthener or strengtheners with the tube at areas of the tube in order to provide increased strength or durability to the heat exchanger; brazing the tube and header at the header joint to form a brazed joint of increased thermal durability is contemplated. In some methods of the present invention, methods comprising a header joint and wherein the method further comprising the step of localizing the tube strengthener or strengtheners at the region of the header joint, and brazing the tube and header at the header joint to form a brazed joint of increased thermal durability are contemplated.

Unless stated otherwise, dimensions and geometries of the various structures depicted herein are not intended to be restrictive of the invention, and other dimensions or geometries are possible. Plural structural components can be provided by a single integrated structure. Alternatively, a single integrated structure might be divided into separate plural components. In addition, while a feature of the present invention may have been described in the context of only one of the illustrated embodiments, such feature may be combined with one or more other features of other embodiments, for any given application. It will also be appreciated from the above that the fabrication of the unique structures herein and the operation thereof also constitute methods in accordance with the present invention.

The preferred embodiment of the present invention has been disclosed. A person of ordinary skill in the art would realize however, that certain modifications would come within the teachings of this invention. Therefore, the following claims should be studied to determine the true scope and content of the invention.

What is claimed is:

1. A method of making a heat exchanger, comprising: a tube, an internal fin or fins, a tube strengthener or strengtheners, a header, and a tube-to-header junction, the method including the steps of:

forming an internal fin or fins;

forming a tube strengthener or strengtheners of a section or sections on the fin or fins;

stuffing the internal fin or fins and the tube strengthener or strengtheners into the tube;

localizing the tube strengthener or strengtheners with the tube at the area of the tube-to-header junction;

forming a header joint at the area of the tube-to-header junction comprising the tube, header and tube strengthener or strengtheners, such that the heat exchanger at the area of the tube and tube strengthener at the header joint provides increased strength or durability to the heat exchanger; and brazing the tube and header to form a brazed header joint of increased thermal durability;

wherein the characteristics of the internal fin or fins are different from the characteristics-of the tube strengthener or strengtheners;

and wherein the internal fin has end sections where the tube strengthener replaces at least one of the first or final fin end section.

2. A method as in claim 1, wherein the heat exchanger comprises an inlet tube and wherein the tube strengthener is found within a first section of the tube, near an end of the inlet tube.

3. A method, as in claim 1, wherein at least one of thickness, cross-sectional pattern, or stiffness of the internal fin or fins is different from at least one of thickness, cross-sectional pattern, or stiffness of the tube strengthener or strengtheners.

4. A method as in claim 3, wherein the fin section comprising a tube strengthener is greater than 25% of the thickness of the tube wall.

5. A method as in claim 4, wherein the tube strengthener and the tube are assembled such that they form a thickened tube strengthening structure after brazing.

6. A method as in claim 5, wherein the thickened tube strengthening structure is formed by brazing the tube strengthener to the interior surface of the tube to provide for an area of resistance to thermal fatigue in the heat exchanger assembly.

7. A method as in claim 5, wherein the tube strengthening structure is located within 25 mm past the end of the inlet tube.

8. A method, as in claim 3, further comprising the step of cutting the tube to its final length prior to stuffing the internal fin with tube strengthener into the tube.

9. A method, as in claim 8, wherein the internal fin with tube strengthener is contained within the same tube assembly.

10. A method as in claim 1, further comprising the steps of stuffing the internal fin with end sections with an automated tube stuffer, wherein the tube strengthener replaces at least one of the first or final internal fin sections when inserted in the tube.

11. A method as in claim 10, wherein the tube strengthener follows the contour of the inner surface of the tube.

12. A method as in claim 11, further comprising the steps of forming a localized contact area such that the tube strengthener abuts the inner surface of the tube at the localized contact area and forms a strengthened joint comprising the tube, tube strengthener and header prior to brazing.

* * * * *